US011237521B2

(12) United States Patent
Kawata et al.

(10) Patent No.: US 11,237,521 B2
(45) Date of Patent: Feb. 1, 2022

(54) TIMEPIECE MOVEMENT AND TIMEPIECE

(71) Applicant: Seiko Instruments Inc., Chiba (JP)

(72) Inventors: Masayuki Kawata, Chiba (JP); Toshiyuki Fujiwara, Chiba (JP); Kazuhiro Fujita, Chiba (JP)

(73) Assignee: SEIKO INSTRUMENTS INC., Chiba (JP)

( * ) Notice: Subject to any disclaimer, the term of this patent is extended or adjusted under 35 U.S.C. 154(b) by 544 days.

(21) Appl. No.: 16/227,039

(22) Filed: Dec. 20, 2018

(65) Prior Publication Data

US 2019/0219969 A1 Jul. 18, 2019

(30) Foreign Application Priority Data

Jan. 17, 2018 (JP) ..... JP2018-005950
Sep. 27, 2018 (JP) ..... JP2018-182255

(51) Int. Cl.
*G04C 3/14* (2006.01)
*G04B 13/00* (2006.01)
*G04B 19/02* (2006.01)

(52) U.S. Cl.
CPC ..... *G04B 19/02* (2013.01); *G04B 13/00* (2013.01); *G04C 3/14* (2013.01); *G04C 3/143* (2013.01)

(58) Field of Classification Search
CPC ..... G04B 19/02; G04B 13/00; G04B 13/02; G04C 3/14; G04C 3/146
See application file for complete search history.

(56) References Cited

U.S. PATENT DOCUMENTS 8,319,468 B2 11/2012 Manaka et al.
2008/0307915 A1* 12/2008 Scheufele ..... G04B 13/027 74/457
2009/0260470 A1* 10/2009 Bannier ..... G04B 35/00 74/461
2010/0040357 A1 2/2010 Kawamoto
2013/0340552 A1* 12/2013 Zaugg ..... G04B 13/027 74/409
2014/0071794 A1 3/2014 Yamamoto et al.
2017/0322519 A1* 11/2017 Lagorgette ..... G04C 3/143

FOREIGN PATENT DOCUMENTS

JP H04-130098 U 11/1992
JP 3625395 B2 3/2005
JP 5363167 B2 12/2013

OTHER PUBLICATIONS

Extended European Search Report for European Application No. 19152348.9, dated May 23, 2019, 7 pages.

* cited by examiner

*Primary Examiner* — Sean Kayes
(74) *Attorney, Agent, or Firm* — Crowell & Moring LLP

(57) ABSTRACT

A timepiece movement includes a motor that has a rotor for rotating an indicating hand, a control unit that rotates the rotor by using a main drive pulse and an auxiliary drive pulse, and that determines a reference position of the indicating hand by detecting a rotation state of the rotor when the indicating hand is rotated using a detection drive pulse based on the main drive pulse, a train wheel that transmits a drive force of the motor to the indicating hand, and that has an indicating hand gear and a second intermediate pinion which mesh with each other, and an elastic portion that is disposed in the indicating hand gear, and that is elastically deformed by coming into contact with the second intermediate pinion when the indicating hand is located at the reference position.

13 Claims, 24 Drawing Sheets

TIMEPIECE MOVEMENT AND TIMEPIECE

RELATED APPLICATIONS

This application claims priority under 35 U.S.C. § 119 to Japanese Patent Application Nos. 2018-005950 filed on Jan. 17, 2018 and 2018-182255 filed on Sep. 27, 2018, the entire content of which are hereby incorporated by reference.

BACKGROUND OF THE INVENTION

1. Field of the Invention

The present invention relates to a timepiece movement and a timepiece.

2. Description of the Related Art

In a timepiece, as a method of detecting a position of an indicating hand, the following method is known, for example. A hole belonging to a gear configuring a train wheel is interposed between a light emitting element and a light receiving element so as to detect the position by determining the presence or absence of transmitted light.

A rotation state detection technique (for example, refer to Japanese Patent No. 5363167) has been proposed in which the indicating hand of the timepiece is driven using a drive pulse used for normal driving so as to detect a rotation state of the indicating hand by using an induced voltage. According to the invention disclosed in Japanese Patent No. 5363167, in a case where the position is detected as a non-rotation state by using the detection method, an indicating hand operation is realized using an auxiliary drive pulse so as to add a rotational force to the indicating hand operation.

Furthermore, the following technique (for example, refer to Japanese Patent No. 3625395) has been proposed. In a case where a control unit of the timepiece detects a predetermined high load corresponding to a reference position of the indicating hand, the control unit determines the high load as the reference position. According to the invention disclosed in Japanese Patent No. 3625395, the control unit identifies the reference position in response to a state where the auxiliary drive pulse is output.

However, in the related art disclosed in Japanese Patent No. 3625395, if there is no load sufficient for outputting the auxiliary drive pulse in a case of detecting the non-rotation state, it is difficult to identify the reference position. In a case of using the auxiliary drive pulse, power consumption required for driving the timepiece increases.

SUMMARY OF THE INVENTION

It is an aspect of the present application to provide a timepiece movement and a timepiece, in which means for grasping a reference position of an indicating hand can be realized using a predetermined load for enabling a normal hand operation.

According to the aspect of the present application, there is provided a timepiece movement including a stepping motor that has a rotor for rotating an indicating hand, a control unit that rotates the rotor by using a main drive pulse and an auxiliary drive pulse, and that determines a reference position of the indicating hand by detecting a rotation state of the rotor when the indicating hand is rotated by using a detection drive pulse based on the main drive pulse, a train wheel that transmits a drive force of the stepping motor to the indicating hand, and that has a first gear and a second gear which mesh with each other, and an elastic portion that is disposed in the first gear, and that is elastically deformed by coming into contact with the second gear when the indicating hand is located at the reference position.

According to the aspect of the present application, the timepiece movement includes the control unit that determines the reference position of the indicating hand by detecting the rotation state of the rotor when the indicating hand is rotated by using the detection drive pulse based on the main drive pulse. Therefore, means for grasping the reference position of the indicating hand can also be realized using a predetermined load for enabling a normal hand operation.

Furthermore, the timepiece movement includes the elastic portion that is disposed in the first gear, and that is elastically deformed by coming into contact with the second gear when the indicating hand is located at the reference position. Accordingly, when the indicating hand is located at the reference position, the elastic portion and the second gear come into contact with each other, and the elastic portion is elastically deformed, thereby causing the train wheel to have an energy loss resulting from the elastic deformation of the elastic portion. In this manner, when the indicating hand is located at the reference position, the rotation state of the rotor can be changed. Therefore, the control unit can determine the reference position of the indicating hand.

Therefore, it is possible to provide the timepiece movement in which the means for grasping the reference position of the indicating hand can be realized using the predetermined load for enabling the normal hand operation.

In the timepiece movement according to the aspect of the present application, it is preferable that the first gear includes an elastic tooth which is a tooth belonging to the first gear, and which has a first tooth surface facing an upstream side in a first rotation direction of the first gear and a second tooth surface facing a downstream side in the first rotation direction. It is preferable that at least any one of the first tooth surface and the second tooth surface is formed from the elastic portion.

According to the aspect of the present application, when rotated in the first rotation direction of the first gear, the tooth of the second gear engages with the elastic tooth from the upstream side in the first rotation direction. Accordingly, the elastic portion can be elastically deformed by coming into contact with the second gear when rotated in the first rotation direction of the first gear. Therefore, the rotation state of the rotor can be changed at least when rotated in the first rotation direction. Accordingly, when rotated in the first rotation direction, the control unit can determine the reference position of the indicating hand.

In the timepiece movement according to the aspect of the present application, it is preferable that the other one of the first tooth surface and the second tooth surface is formed from a rigid body.

According to the aspect of the present application, the other one of the first tooth surface and the second tooth surface is not elastically displaced. Accordingly, in a state where the second gear engages with the other one, displaced engagement between the elastic tooth and the second gear can be prevented. Therefore, the first gear and the second gear can accurately mesh with each other.

In the timepiece movement according to the aspect of the present application, it is preferable that the elastic tooth is one tooth of a plurality of teeth belonging to the first gear.

According to the aspect of the present application, for example, compared to a case where a plurality of elastic teeth are aligned with each other, it is possible to narrow an arrangement range of the indicating hand when a load received by the rotor fluctuates. Therefore, the reference position of the indicating hand can be accurately grasped.

In the timepiece movement according to the aspect of the present application, it is preferable that the first gear may include a pair of elastic teeth belonging to the first gear and adjacent to each other. It is preferable that a width of a tooth groove between the pair of elastic teeth is smaller than a tooth thickness of the tooth belonging to the second gear. It is preferable that the respective pair of elastic teeth have facing tooth surfaces which face each other in a circumferential direction. It is preferable that the facing tooth surfaces are formed from the elastic portion.

According to the aspect of the present application, the width of the tooth groove between the pair of elastic teeth is smaller than the tooth thickness of the tooth belonging to the second gear. Accordingly, when the tooth belonging to the second gear enters the tooth groove between the pair of elastic teeth, the tooth belonging to the second gear can be brought into contact with the facing tooth surface of each of the pair of elastic teeth. The facing tooth surface of the elastic tooth is formed from the elastic portion. Accordingly, the pair of elastic portions is elastically deformed by coming into contact with the second gear regardless of the rotation direction of the first gear. Therefore, the rotation state of the rotor can be changed by elastically deforming the elastic portion regardless of the rotation direction of the first gear. Accordingly, when the first gear is rotated, the control unit can determine the reference position of the indicating hand.

In the timepiece movement according to the aspect of the present application, it is preferable that the first gear has a first tooth and a second tooth which are adjacent to each other. It is preferable that the elastic portion is located between the first tooth and the second tooth, and comes into contact with the second gear at least either when the first tooth and second gear engage with each other or when the second tooth and the second gear engage with each other.

According to the aspect of the present application, the rotation state of the rotor can be changed by elastically deforming the elastic portion when rotated in at least any direction of the first gear. Therefore, when rotated in at least any direction of the first gear, the control unit can determine the reference position of the indicating hand.

In the timepiece movement according to the aspect of the present application, it is preferable that at least a portion of the elastic portion is a cantilever beam which extends in a direction intersecting a radial direction of the first gear, and whose free end is located between the first tooth and the second tooth.

According to the aspect of the present application, the portion extending along the direction intersecting the radial direction of the first gear in the elastic portion is bent. In this manner, the free end can be elastically displaced along the radial direction of the first gear. Therefore, it is possible to form the elastic portion which is elastically deformed by coming into contact with the second gear.

In the timepiece movement according to the aspect of the present application, it is preferable that the first gear includes an elastic tooth which is a tooth belonging to the first gear, and in which one entire tooth of a plurality of teeth is formed of the elastic portion.

According to the aspect of the present application, when the second gear engages with the elastic tooth, the second gear comes into contact with the elastic portion regardless of the rotation direction of the first gear. In this manner, the elastic portion is elastically deformed regardless of the rotation direction of the first gear. Accordingly, the rotation state of the rotor can be changed by elastically deforming the elastic portion regardless of the rotation direction of the first gear. Therefore, when the first gear is rotated, the control unit can determine the reference position of the indicating hand.

In the timepiece movement according to the aspect of the present application, it is preferable that a width of a tooth groove between the elastic tooth and a tooth adjacent to the elastic tooth is smaller than a tooth thickness of a tooth belonging to the second gear.

According to the aspect of the present application, when the tooth belonging to the second gear enters the tooth groove between the elastic tooth and the tooth adjacent to the elastic tooth, the tooth belonging to the second gear can be brought into contact with the elastic tooth. In this manner, the elastic portion is elastically deformed by coming into contact with the second gear, not only in a state where the elastic tooth engages with the second gear, but also in a state where the tooth adjacent to the elastic tooth engages with the second gear. In this manner, the rotation state of the rotor can be changed for a longer period of time. Therefore, the control unit can achieve improved accuracy in detecting the reference position of the indicating hand.

In the timepiece movement according to the aspect of the present application, it is preferable that the plurality of teeth belonging to the first gear include the elastic tooth and a standard tooth. It is preferable that a tooth tip of the elastic tooth is formed in a shape the same as that of a portion on a tooth tip side from a pitch circle of the first gear in the standard tooth.

According to the aspect of the present application, it is possible to prevent the elastic tooth from fitting into a tooth bottom of the second gear. A shape of the tooth tip of the elastic tooth is formed so as to be the same as a shape of the tooth tip of the standard tooth. Accordingly, even if the shape of the tooth tip of the elastic tooth is unstable when manufactured, it is possible to prevent the second gear and the elastic tooth from poorly meshing with each other. In this manner, it is possible to prevent the energy loss caused by the elastic deformation of the elastic portion from being significantly poorer beyond a desired magnitude. According to the above-described configuration, the fluctuation of the load received by the rotor can be stabilized.

In the timepiece movement according to the aspect of the present application, it is preferable that the elastic portion is a cantilever beam whose free end has the elastic tooth, and has a wide portion which is formed to be wider than the elastic tooth while being adjacent to a base end side of the elastic tooth.

According to the aspect of the present application, compared to a case where the elastic portion does not have the wide portion, it is possible to improve rigidity of a site adjacent to the base end side of the elastic tooth in the elastic portion. Accordingly, the site adjacent to the elastic tooth is prevented from being locally bent in the elastic portion. In this manner, the elastic tooth can be displaced in a desired trajectory by bending the entire elastic portion. Therefore, the fluctuation of the load received by the rotor can be stabilized.

In the timepiece movement according to the aspect of the present application, it is preferable that the elastic portion is formed so that a torque transmission direction in a contact portion between the first gear and the second gear is more greatly inclined to a straight line perpendicular to a center line between the first gear and the second gear in a contact state between the elastic portion and the second gear, compared to an engagement state between a site other than the elastic portion in the first gear and the second gear.

According to the aspect of the present application, transmission efficiency of the drive force of the stepping motor between the first gear and the second gear becomes poorer in the contact state between the elastic portion and the second gear, compared to the engagement state between the site other than the elastic portion in the first gear and the second gear. Therefore, it is possible to increase the load received by the rotor when the indicating hand is located at the reference position.

In the timepiece movement according to the aspect of the present application, it is preferable that the indicating hand is attached to the first gear.

According to the aspect of the present application, the elastic portion can be displaced in synchronization with the indicating hand. Accordingly, compared to a case where the elastic portion is disposed in the gear other than the first gear included in the train wheel which is the same as the first gear, it is possible to more accurately grasp the reference position of the indicating hand.

According to another aspect of the present application, there is provided a timepiece including the timepiece movement.

According to the aspect of the present application, it is possible to provide the timepiece in which the means for grasping the reference position of the indicating hand can be realized using the predetermined load for enabling the normal hand operation.

According to the aspect of the present application, it is possible to provide the timepiece movement and the timepiece, in which the means for grasping the reference position of the indicating hand can be realized using the predetermined load for enabling the normal hand operation.

DETAILED DESCRIPTION OF THE PREFERRED EMBODIMENTS

Figure 1:
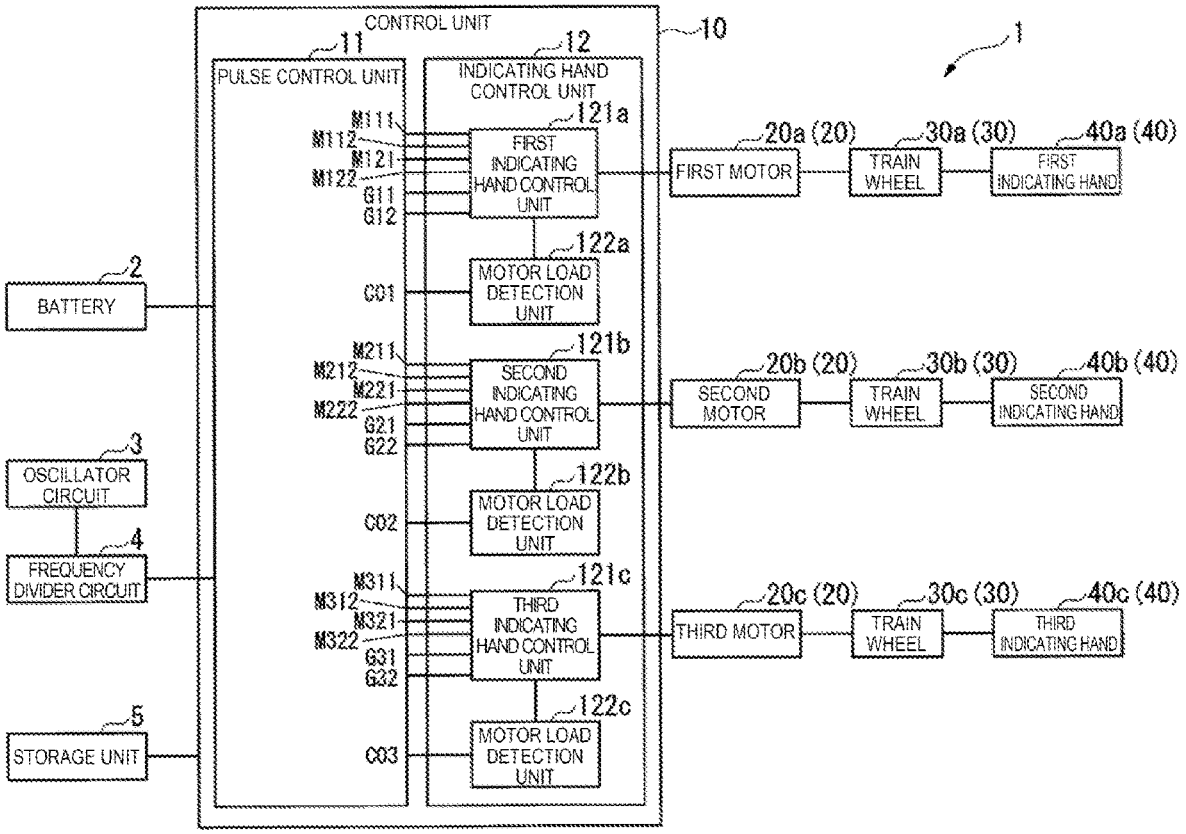
FIG. 1 is a block diagram illustrating a configuration example of a timepiece according to a first embodiment.

Hereinafter, embodiments according to the present invention will be described with reference to the drawings. In the following description, the same reference numerals will be given to configurations having the same or similar function. Repeated description of the configurations may be omitted in some cases.

First Embodiment

FIG. 1 is a block diagram illustrating a configuration example of a timepiece 1 according to a first embodiment.

As illustrated in FIG. 1, the timepiece 1 includes a battery 2, an oscillator circuit 3, a frequency divider circuit 4, a storage unit 5, a control unit 10, a first motor 20*a*, a second motor 20*b*, a third motor 20*c*, a train wheel 30*a*, a train wheel 30*b*, a train wheel 30*c*, a first indicating hand 40*a*, a second indicating hand 40*b*, and a third indicating hand 40*c*.

The control unit 10 includes a pulse control unit 11 and an indicating hand drive unit 12.

The indicating hand drive unit 12 includes a first indicating hand drive unit 121*a*, a motor load detection unit 122*a*, a second indicating hand drive unit 121*b*, a motor load detection unit 122*b*, a third indicating hand drive unit 121*c*, and a motor load detection unit 122*c*.

A timepiece movement includes at least the storage unit 5, the control unit 10, the first motor 20*a*, the second motor 20*b*, the third motor 20*c*, the train wheel 30*a*, the train wheel 30*b*, and the train wheel 30*c*.

In a case where one of the first motor 20*a*, the second motor 20*b*, and the third motor 20*c* is not specified, all of these will be collectively referred to as a motor 20. In a case where one of the train wheel 30*a*, the train wheel 30*b*, and the train wheel 30*c* is not specified, all of these will be collectively referred to as a train wheel 30. In a case where one of the first indicating hand 40*a*, the second indicating hand 40*b*, and the third indicating hand 40*c* is not specified, all of these will be collectively referred to as an indicating hand 40. In a case where one of the first indicating hand drive unit 121*a*, the second indicating hand drive unit 121*b*, and the third indicating hand drive unit 121*c* is not specified, all of these will be collectively referred to as an indicating hand drive unit 121. In a case where one of the motor load detection unit 122*a*, the motor load detection unit 122*b*, and the motor load detection unit 122*c* is not specified, all of these will be collectively referred to as a motor load detection unit 122.

The timepiece 1 illustrated in FIG. 1 is an analog timepiece which displays a measured time by using the indicating hand 40. In the example illustrated in FIG. 1, the timepiece 1 includes three indicating hands 40. However, the number of the indicating hands 40 may be one, two, four, or more. In this case, for each of the indicating hands 40, the timepiece 1 includes the indicating hand drive unit 121, the motor load detection unit 122, the motor 20, and the train wheel 30.

For example, the battery 2 is a lithium battery or a silver oxide battery, which is a so-called button battery. The battery 2 may be a solar battery and a storage battery for storing power generated by the solar battery. The battery 2 supplies the power to the control unit 10.

For example, the oscillator circuit 3 is a passive element used in order to oscillate a predetermined frequency from mechanical resonance thereof by utilizing a piezoelectric phenomenon of a crystal. Here, the predetermined frequency is 32 kHz, for example.

The frequency divider circuit 4 divides a signal having the predetermined frequency output by the oscillator circuit 3 into a desired frequency, and outputs the divided signal to the control unit 10.

The storage unit 5 stores a main drive pulse and an auxiliary drive pulse for each of the first indicating hand 40*a*, the second indicating hand 40*b*, and the third indicating hand 40*c*. The main drive pulse and the auxiliary drive pulse will be described later. The storage unit 5 stores a search pulse for each of the first indicating hand 40*a*, the second indicating hand 40*b*, and the third indicating hand 40*c*. The search pulse is used when a reference position of the indicating hand 40 is detected. The search pulse and detecting the reference position will be described later. The storage unit 5 stores data in association with a combination of an output of a comparator Q7 (refer to FIG. 3) included in the motor load detection unit 122 in sections T1 to T3, a rotation state, and a state of the motor 20. The sections T1 to T3 will be described later with reference to FIG. 7. The storage unit 5 stores a predetermined cycle, a pulse width in a drive pulse (to be described later), the number of pulses in the drive pulse, and the number of changed pulses. The storage unit 5 stores a program used by the control unit 10 for controlling.

The control unit 10 measures time by using the desired frequency divided by the frequency divider circuit 4, and drives the motor 20 so that the indicating hand 40 is operated in response to a time measurement result. The control unit 10 detects a reverse voltage (induced voltage) generated by the rotation of the motor 20, and detects the reference position of the indicating hand 40, based on a detected result. A detection method of the reference position will be described later.

The pulse control unit 11 measures the time by using the desired frequency divided by the frequency divider circuit 4, generates a pulse signal so as to operate the indicating hand 40 in response to the time measurement result, and outputs the generated pulse signal to the indicating hand drive unit 12. The pulse control unit 11 acquires a comparison result between the induced voltage generated in the motor 20 which is detected by the indicating hand drive unit 12 and a reference voltage. Based on an acquired result, the pulse control unit 11 detects the reference position.

In the pulse control unit 11, a drive terminal M111, a drive terminal M112, a drive terminal M121, a drive terminal M122, a control terminal G11, and a control terminal G12 are connected to the first indicating hand drive unit 121*a*. A detection terminal CO1 is connected to the motor load detection unit 122*a*. A drive terminal M211, a drive terminal M212, a drive terminal M221, a drive terminal M222, a control terminal G21, and a control terminal G22 are connected to the second indicating hand drive unit 121*b*. A detection terminal CO2 is connected to the motor load detection unit 122*b*. A drive terminal M311, a drive terminal M312, a drive terminal M321, a drive terminal M322, a control terminal G31, and a control terminal G32 are connected to the third indicating hand drive unit 121*c*. A detection terminal CO3 is connected to the motor load detection unit 122*c*.

The indicating hand drive unit 12 drives the motor 20 in response to the pulse signal output by the pulse control unit 11, thereby operating the indicating hand 40. The indicating hand drive unit 12 detects the induced voltage generated when the motor 20 is driven, and outputs the comparison result between the detected induced voltage and the reference voltage to the pulse control unit 11.

The first indicating hand drive unit 121*a* generates the pulse signal for rotating the first motor 20*a* forward or rearward in accordance with the control of the pulse control unit 11. The first indicating hand drive unit 121*a* drives the first motor 20*a* by using the generated pulse signal.

The second indicating hand drive unit 121*b* generates the pulse signal for rotating the second motor 20*b* forward or rearward in accordance with the control of the pulse control unit 11. The second indicating hand drive unit 121*b* drives the second motor 20*b* by using the generated pulse signal.

The third indicating hand drive unit 121*c* generates the pulse signal for rotating the third motor 20*c* forward or rearward in accordance with the control of the pulse control unit 11. The third indicating hand drive unit 121*c* drives the third motor 20*c* by using the generated pulse signal.

The motor load detection unit 122*a* detects the reverse voltage generated in the first indicating hand drive unit 121*a* by the rotation of the first motor 20*a*, compares the detected reverse voltage with a reference voltage Vcomp which is a threshold value, and outputs the comparison result to the pulse control unit 11.

The motor load detection unit 122*b* detects the reverse voltage generated in the second indicating hand drive unit 121*b* by the rotation of the second motor 20*b*, compares the detected reverse voltage with the reference voltage Vcomp, and outputs the comparison result to the pulse control unit 11.

The motor load detection unit 122*c* detects the reverse voltage generated in the third indicating hand drive unit 121*c* by the rotation of the third motor 20*c*, compares the detected reverse voltage with the reference voltage Vcomp, and outputs the comparison result to the pulse control unit 11.

The first motor 20*a*, the second motor 20*b*, and the third motor 20*c* are respectively stepping motors, for example. The first motor 20*a* drives the first indicating hand 40*a* via the train wheel 30*a* by using the pulse signal output by the first indicating hand drive unit 121*a*. The second motor 20*b* drives the second indicating hand 40*b* via the train wheel 30*b* by using the pulse signal output by the second indicating hand drive unit 121*b*. The third motor 20*c* drives the third indicating hand 40*c* via the train wheel 30*c* by using the pulse signal output by the third indicating hand drive unit 121*c*.

The train wheel 30*a*, the train wheel 30*b*, and the train wheel 30*c* respectively have at least one gear. The train wheel 30*a* transmits a drive force of the first motor 20*a* to the first indicating hand 40*a*. The train wheel 30*b* transmits the drive force of the second motor 20*b* to the second indicating hand 40*b*. The train wheel 30*c* transmits the drive force of the third motor 20*c* to the third indicating hand 40*c*. A gear belonging to the train wheel 30 has a reference load unit. The reference load unit is configured to apply fluctuation to a load (torque) received by a rotor 202 when the indicating hand 40 is located at the reference position. That is, the train wheel 30 is formed so that the load fluctuates at one location while the indicating hand 40 is rotated 360 degrees. Each detailed configuration of the train wheel 30 and the reference load unit will be described later.

For example, the first indicating hand 40*a* is an hour hand. For example, the second indicating hand 40*b* is a minute hand. For example, the third indicating hand 40*c* is a second hand. The first indicating hand 40*a*, the second indicating hand 40*b*, and the third indicating hand 40*c* are respectively supported so as to be rotatable by a support body (not illustrated).

Next, the reference load unit and the reference position will be described.

Figure 2:
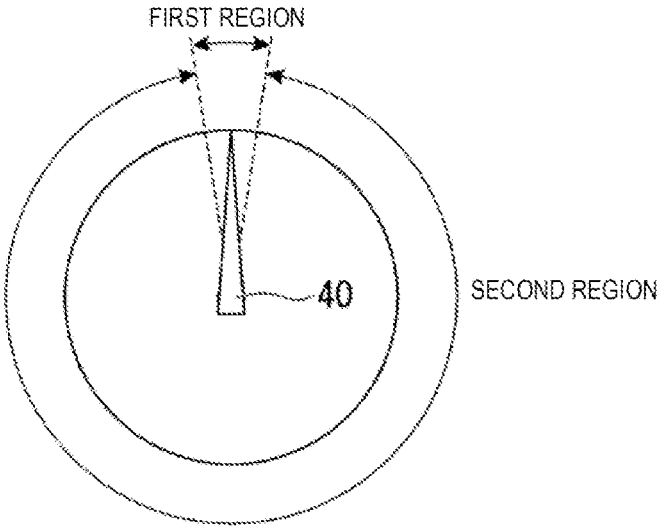
FIG. 2 is a view for describing an example of a reference load unit and a reference position according to the first embodiment.

FIG. 2 is a view for describing an example of the reference load unit and the reference position according to the present embodiment. For example, the indicating hand 40 in FIG. 2 represents the third indicating hand 40*c* which is the second hand.

In FIG. 2, when a position of approximately 12 o'clock is the reference position and the indicating hand is located at this position (first region), compared to the other position (second region), the load received by the rotor 202 is high. That is, in the example illustrated in FIG. 2, the reference load unit is disposed at the position of approximately 12 o'clock. In other words, the load of the first region which is received by the rotor 202 is higher than the load of the second region. According to the present embodiment, the position where the load received by the rotor 202 increases is detected as the reference position.

FIG. 2 illustrates an example in which the position of approximately 12 o'clock is the reference position. However, the reference position may be the other position. The respective reference positions of the first indicating hand 40*a*, the second indicating hand 40*b*, and the third indicating hand 40*c* may be the same position or mutually different positions.

Next, a configuration example of the indicating hand drive unit 121 and the motor load detection unit 122 will be described.

Figure 3:
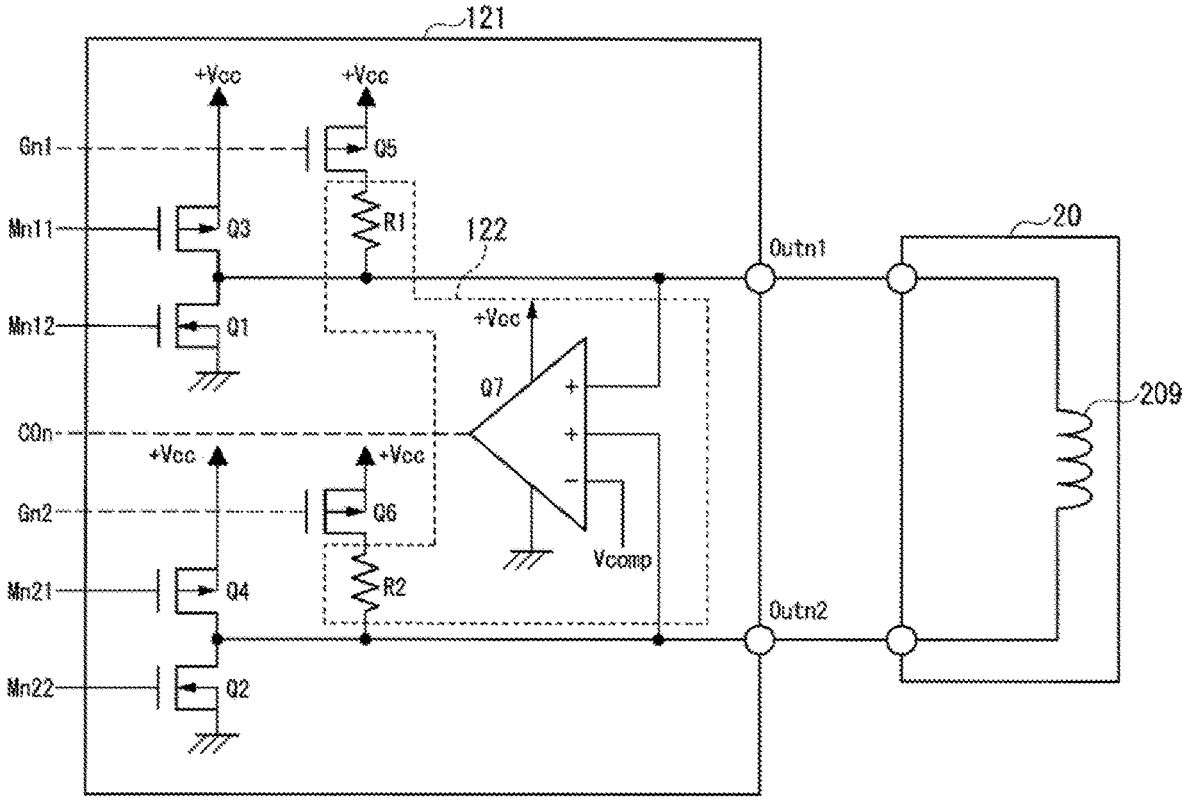
FIG. 3 is a block diagram illustrating a configuration example of an indicating hand drive unit and a motor load detection unit according to the first embodiment.

FIG. 3 is a block diagram illustrating the configuration example of the indicating hand drive unit 121 and the motor load detection unit 122 according to the present embodiment.

As illustrated in FIG. 3, the indicating hand drive unit 121 includes switching elements Q1 to Q6. The motor load detection unit 122 includes resistors R1 and R2 and a comparator Q7.

In the switching element Q3, a gate is connected to a drive terminal Mn11 (n is any one of 1 to 3) of the pulse control unit 11, a source is connected to a power source +Vcc, and a drain is connected to a drain of the switching element Q1, one end of the resistor R1, a first input portion (+) of the comparator Q7, and a first output terminal Outn1.

In the switching element Q1, a gate is connected to a drive terminal Mn12 of the pulse control unit 11, and a source is grounded.

In the switching element Q5, a gate is connected to a control terminal Gn1 of the pulse control unit 11, a source is connected to the power source +Vcc, and a drain is connected to the other end of the resistor R1.

In the switching element Q4, a gate is connected to a drive terminal Mn21 of the pulse control unit 11, a source is connected to the power source +Vcc, and a drain is connected to a drain of the switching element Q2, one end of the resistor R2, a second input portion (+) of the comparator Q7, and a second output terminal Outn2.

In the switching element Q2, a gate is connected to a drive terminal Mn22 of the pulse control unit 11, and a source is grounded.

In the switching element Q6, a gate is connected to a control terminal Gn2 of the pulse control unit 11, a source is connected to the power source +Vcc, and a drain is connected to the other end of the resistor R2.

In the comparator Q7, the reference voltage Vcomp is supplied to a third input portion (−), and an output portion is connected to a detection terminal Con of the pulse control unit 11.

The motor 20 is connected to both ends of the first output terminal Outn1 and the second output terminal Outn2 of the indicating hand drive unit 121.

For example, each of the switching elements Q3, Q4, Q5, and Q6 is a P-channel field effect transistor (FET). For example, each of the switching elements Q1 and Q2 is an N-channel FET.

The switching elements Q1 and Q2 are configuration elements for driving the motor 20. The switching element Q5 and Q6, and the resistor R1 and the resistor R2 are configuration elements for detecting the rotation. The switching elements Q3 and Q4 are configuration elements used for both driving the motor 20 and detecting the rotation of the motor 20. The switching elements Q1 to Q6 are respectively low impedance elements having low ON-resistance in an ON-state. Resistance values of the resistors R1 and R2 are the same as each other, and are greater than a value of the ON-resistance of the switching element.

The indicating hand drive unit 121 brings the switching elements Q1 and Q4 into an ON-state at the same time, and brings the switching elements Q2 and Q3 into an OFF-state at the same time. In this manner, the indicating hand drive unit 121 supplies an electric current flowing in a forward direction to a drive coil 209 included in the motor 20, thereby rotationally driving the motor 20 by 180 degrees in the forward direction. The indicating hand drive unit 121 brings the switching elements Q2 and Q3 into the ON-state at the same time, and brings the switching elements Q1 and Q4 into the OFF-state at the same time. In this manner, the indicating hand drive unit 121 supplies the electric current flowing in a rearward direction to the drive coil 209, thereby rotationally driving the motor 20 by further 180 degrees in the forward direction.

Next, an example of the drive signal output by the pulse control unit 11 will be described.

Figure 4:
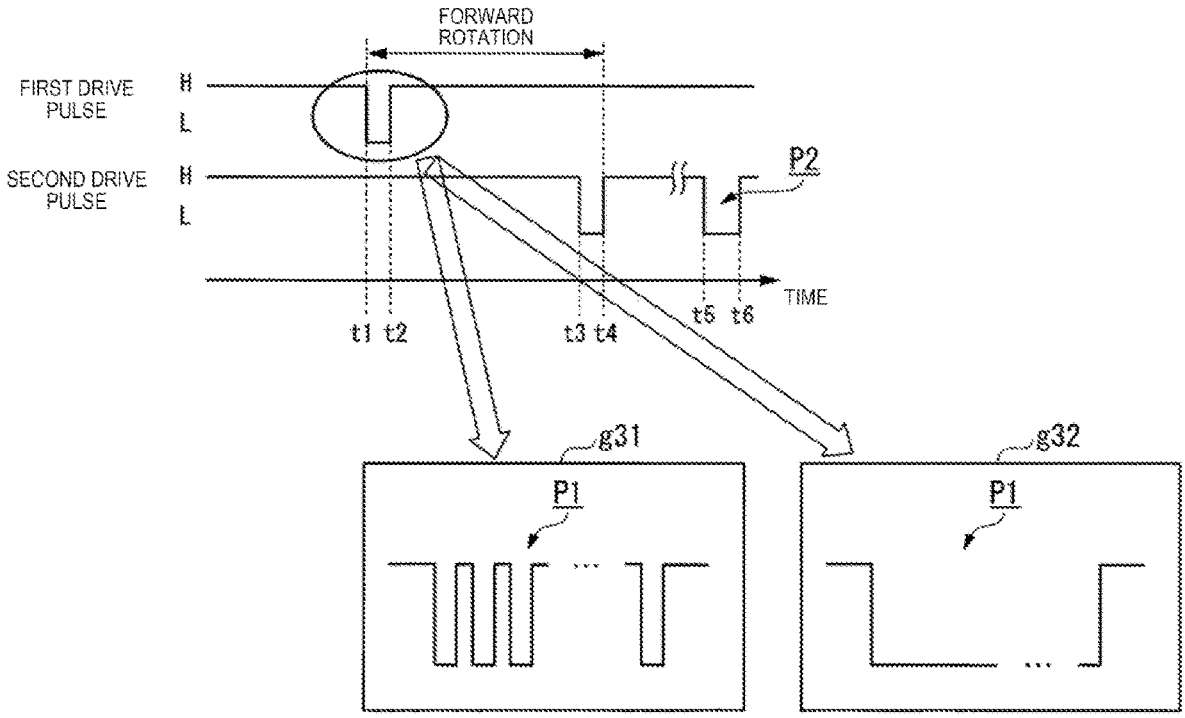
FIG. 4 is a view illustrating an example of a drive pulse output by a pulse control unit according to the first embodiment.

FIG. 4 is a view illustrating an example of the drive pulse output by the pulse control unit 11 according to the present embodiment.

In FIG. 4, a horizontal axis represents a time, and a vertical axis represents whether the signal is in an H (high) level or in an L (low) level. A waveform P1 is a waveform of a first drive pulse. A waveform P2 is a waveform of a second drive pulse.

During a period of times t1 to t6, the motor 20 is rotated forward. During a period of times t1 to t2, the pulse control unit 11 generates a first drive pulse Mn1. During a period of times t3 to t4, the pulse control unit 11 generates a second drive pulse Mn2 The drive signal generated during the period of times t1 to t2 or the period of times t3 to t4 is configured to include a plurality of pulse signals as in a region indicated by a reference numeral g31, and the pulse control unit 11 adjusts a pulse duty. In this case, the period of times t1 to t2 or the period of times t3 to t4 is changed in accordance with the pulse duty. Hereinafter, in the present embodiment, a signal wave of the region indicated by the reference numeral g31 will be referred to as a "comb tooth wave". The drive signal generated during the period of times t1 to t2 or the period of times t3 to t4 is configured to include one pulse signal as in the region indicated by a reference numeral g32, and the pulse control unit 11 adjusts a pulse width. In this case, the period of times t1 to t2 or the period of times t3 to t4 is changed in accordance with the pulse width. Hereinafter, in the present embodiment, a signal wave of the region indicated by the reference numeral g32 will be referred to as a "rectangular wave".

In the present embodiment, a pulse generated during the period of times t1 to t2 or the period of times t3 to t4 will be referred to as a main drive pulse P1. In the following description, an example will be described in which the main drive pulse P1 is the comb tooth wave.

An auxiliary drive pulse P2 generated during a period of times t5 to t6 is a drive pulse to be output only when it is detected that the rotor is not rotated by the main drive pulse P1.

In the embodiment, a state where the indicating hand 40 is operated using the main drive pulse (detection drive pulse) without using the auxiliary drive pulse will be referred to as a first rotation state. Furthermore, a state that the indicating hand is operated using the auxiliary drive pulse after the first rotation state will be referred to as a second rotation state.

Next, a configuration example of the motor 20 will be described.

Figure 5:
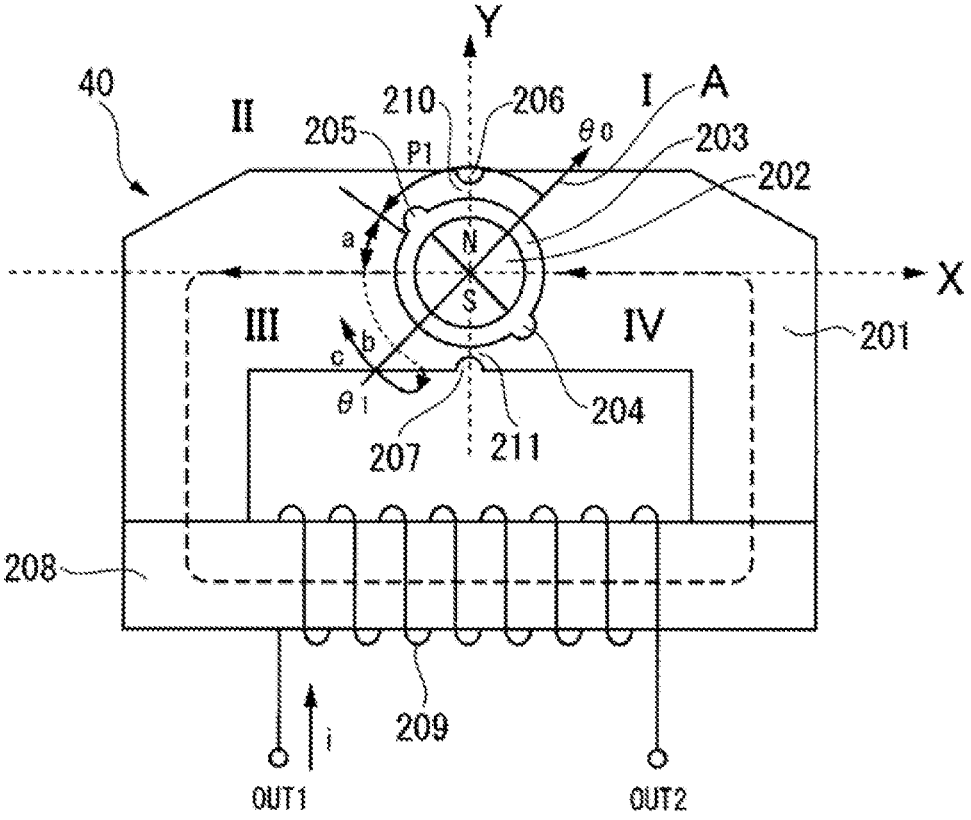
FIG. 5 is a view illustrating a configuration example of a motor according to the first embodiment.

FIG. 5 illustrates the configuration example of the motor 20 according to the present embodiment.

As illustrated in FIG. 5, in a case where the motor 20 is used for an analog electronic timepiece, a stator 201 and a coil core 208 are fixed to a main plate (not illustrated) by a screw (not illustrated), and are joined to each other. The drive coil 209 has a first terminal OUT1 and a second terminal OUT2.

The rotor 202 is magnetized in two poles (south pole and north pole). A pinion 202*a* (refer to FIG. 10) is disposed in the rotor 202.

The stator 201 is formed of a magnetic material. An outer end portion of the stator 201 is provided with a plurality of (two in the present embodiment) cutout portions (outer notches) 206 and 207 at positions facing each other across a rotor accommodating through-hole 203. Saturable portions 210 and 211 are disposed between the respective outer notches 206 and 207 and the rotor accommodating through-hole 203.

The saturable portions 210 and 211 are not magnetically saturated depending on a magnetic flux of the rotor 202, and are configured so as to be magnetically saturated and magnetic resistance increases when the drive coil 209 is excited. The rotor accommodating through-hole 203 is configured to have a circular hole shape in which a plurality of (two in the present embodiment) crescentic cutout portions (inner notches) 204 and 205 are integrally formed in facing portions of a through-hole having a circular contour.

The cutout portions 204 and 205 configure a positioning portion for determining a stop position of the rotor 202. In a state where the drive coil 209 is not excited, the rotor 202 is located at a position corresponding to the positioning portion as illustrated in FIG. 5. In other words, the rotor 202 is stably stopped at a position (position of an angle θ0) where a magnetic pole axis A of the rotor 202 is perpendicular to a line segment connecting the cutout portions 204 and 205 to each other. An XY-coordinate space centered on a rotation axis (rotation center) of the rotor 202 is divided into four quadrants (first quadrant I to fourth quadrant IV).

Here, the main drive pulse having the rectangular wave is supplied from the indicating hand drive unit 121 to between the terminals OUT1 and OUT2 of the drive coil 209 (for example, the first terminal OUT1 side is set to a cathode, and the second terminal OUT2 side is set to an anode). If a drive current flows in a direction indicated by an arrow in FIG. 5, a magnetic flux is generated in the stator 201 in a direction indicated by a broken line arrow. In this manner, the saturable portions 210 and 211 are saturated and the magnetic resistance of the resistor increases. Thereafter, due to interaction between the magnetic pole generated in the stator 201 and the magnetic pole of the rotor 202, the rotor 202 is rotated 180 degrees in the direction indicated by the arrow in FIG. 5, and is stably stopped at a position where the magnetic pole axis shows an angle θ1. A rotation direction (counterclockwise direction in FIG. 5) for allowing a normal operation (indicating hand operation since the present embodiment employs the analog electronic timepiece) to be performed by rotationally driving the motor 20 will be referred to as the forward direction, and a direction opposite thereto (clockwise direction in FIG. 5) will be referred to as the rearward direction.

If the drive current i in a direction opposite to the arrow in FIG. 5 by supplying the main drive pulse having the rectangular wave of the opposite polarity from the indicating hand drive unit 121 to the terminals OUT1 and OUT2 of the drive coil 209 (the first terminal OUT1 side is set to the anode, and the second terminal OUT2 side is set to the cathode so as to have the opposite polarity compared to the precedent driving), the magnetic flux is generated in the stator 201 in the direction opposite to the broken arrow. In this manner, the saturable portions 210 and 211 are first saturated. Thereafter, due to the interaction between the magnetic pole generated in the stator 201 and the magnetic pole of the rotor 202, the rotor 202 is rotated 180 degrees in the same direction (forward direction), and is stably stopped at a position where the magnetic pole axis shows the angle θ0.

Thereafter, in this way, the indicating hand drive unit 121 supplies a signal (alternating signal) having different polarity to the drive coil 209. In this manner, the motor 20 repeatedly performs the operation. A configuration is adopted in which the rotor 202 can be continuously rotated every 180 degrees in the direction of the arrow.

The indicating hand drive unit 121 rotationally drives the motor 20 by alternately driving the motor 20 by using the drive pulse P1 having mutually different polarities. In a case where the motor 20 cannot be rotated using the main drive pulse P1, the motor 20 is rotationally driven using the auxiliary drive pulse P2 having the polarity the same as the polarity of the main drive pulse P1 after a section T3 (to be described later).

Next, an operation of the switching elements Q1 to Q6 when the motor 20 is driven and an example of the induced voltage generated when the motor is rotated will be described. In the following example, a case where the motor 20 is rotated forward will be described.

Figure 6:
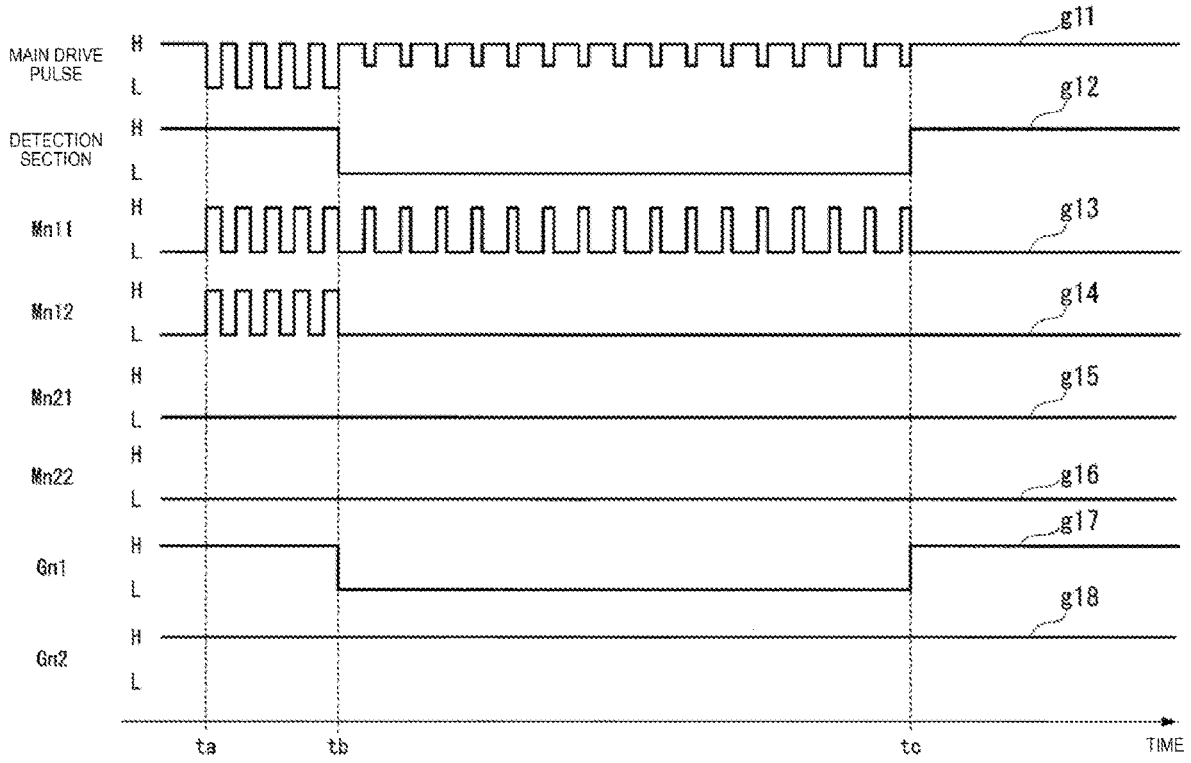
FIG. 6 is a view illustrating an example of a main drive pulse and an induced voltage generated when the motor is rotated according to the first embodiment.

FIG. 6 illustrates an example of the main drive pulse P1 and the example of the induced voltage generated when the motor is rotated according to the present embodiment. In FIG. 6, the horizontal axis represents a time, and the vertical axis represents whether the signal is in an H-level or in an L-level. A waveform g11 is a waveform of the main drive pulse P1 and the detection pulse which are output from the first output terminal Outn1 of the indicating hand drive unit 121. A waveform g12 indicates a detection section. A waveform g13 is a waveform of a control signal Mn11 input to the gate of the switching element Q3. A waveform g14 is a waveform of a control signal Mn12 input to the gate of the switching element Q1. A waveform g15 is a waveform of a control signal Mn21 input to the gate of the switching element Q4. A waveform g16 is a waveform of a control signal Mn22 input to the gate of the switching element Q2. A waveform g17 is a waveform of a control signal Gn1 input to the gate of the switching element Q5. A waveform g18 is a waveform of a control signal Gn2 input to the gate of the switching element Q6.

A state illustrated in FIG. 6 represents a state during the period of times t1 to t3 in FIG. 4.

In FIG. 6, in the switching elements Q3, Q4, Q5, and Q6, the signal input to the gate in a period of the L-level and the ON-state, and the signal input to the gate is in a period of the H-level and the OFF-state. In the switching elements Q1 and Q2, the signal input to the gate is in a period of the H-level and the ON-state, and the signal input to the gate is in a period of the L-level and the OFF-state.

A period of times ta to tb represents a drive section.

A period of times tb to tc represents a detection section in a rotation state.

During the period of times ta to tb representing the drive section, as illustrated by the waveform g13 and the waveform g14, the pulse control unit 11 switches the switching elements Q3 and Q1 between the ON-state and the OFF-state at a predetermined cycle in response to the main drive pulse P1 having the comb tooth wave. In this manner, the pulse control unit 11 controls the motor 20 to be rotated in the forward direction. In a case where the motor 20 is normally rotated, the rotor included in the motor 20 is rotated 180 degrees in the forward direction. During this period, the switching elements Q2, Q5, and Q6 are respectively in the OFF-state, and the switching element Q4 is in the ON-state.

During the period of times tb to tc representing the detection section, the pulse control unit 11 maintains the OFF-state of the switching element Q1, switches the switching element Q3 between the ON-state and the OFF-state at a predetermined timing, and controls the switching element Q3 to be in a high-impedance state. In this detection section, the pulse control unit 11 controls the switching element Q5 to be switched to the ON-state. During the detection period, the pulse control unit 11 maintains the on-state of the switching element Q4, and controls the switching elements Q2 and Q6 to be switched to the OFF-state.

In this manner, in the detection section, a detection loop in which the switching elements Q4 and Q5 are in the ON-state and the switching element Q3 is in the OFF-state, and a closed loop in which the switching elements Q4 and Q5 are in the ON-state and the switching element Q3 is in the ON-state are alternately repeated at a predetermined cycle. In this case, in a state of the detection loop, the loop is configured to include the switching elements Q4 and Q5 and the resistor R1. Accordingly, the motor 20 is not braked. On the other hand, in a state of the closed loop, the loop is configured to include the switching elements Q3 and Q4 and the drive coil 209 belonging to the motor 20. Thus, the drive coil 209 is short-circuited. Accordingly, the motor 20 is braked, and free vibration of the motor 20 is suppressed.

In the detection section, the induced current flows in the resistor R1 in the direction the same as the flowing direction of the drive current. As a result, an induced voltage signal VRs is generated in the resistor R1. The comparator Q7 compares the induced voltage signal VRs and the reference voltage Vcomp with each other for each of the sections T1, T2 and T3. In a case where the induced voltage signal VRs is equal to or smaller than the reference voltage Vcomp, the comparator Q7 outputs a signal indicating "1". In a case where the induced voltage signal VRs is greater than the reference voltage Vcomp, the comparator Q7 outputs a signal indicating "0". As will be described later with reference to FIG. 7, the section T1 is the first section in the detection section. The section T2 is the second section in the detection section, and the section T3 is the third section in the detection section.

During a period of times t3 to t5 in FIG. 4, a second drive pulse is generated. In this manner, in the drive section, the pulse control unit 11 switches the switching elements Q4 and Q2 between the ON-state and the OFF-state at a predetermined cycle in response to the main drive pulse P1. In this manner, the pulse control unit 11 controls the motor 20 to be rotated in the forward direction. During this period, the switching elements Q1, Q5, and Q6 are respectively in the OFF-state, and the switching element Q3 is in the ON-state.

In the detection section, the pulse control unit 11 maintains the OFF-state of the switching element Q2, switches the switching element Q4 between the ON-state and the OFF-state at a predetermined timing, and controls the switching element Q4 to be in a high-impedance state. In the detection section, the pulse control unit 11 controls the switching element Q6 to be switched to the ON-state. During the detection period, the pulse control unit 11 maintains the ON-state of the switching element Q3, and controls the switching elements Q1 and Q5 to be in the OFF-state. In this manner, the induced current flows in the resistor R2 in the direction the same as the flowing direction of the drive current. As a result, the induced voltage signal VRs is generated in the resistor R2. The comparator Q7 compares the induced voltage signal VRs and the reference voltage Vcomp with each other for each section of the sections T1, T2, and T3. In a case where the induced voltage signal VRs is equal to or smaller than the reference voltage Vcomp, the comparator Q7 outputs the signal indicating "1". In a case where the induced voltage signal VRs is greater than the reference voltage Vcomp, the comparator Q7 outputs the signal indicating "0".

Next, a relationship between a load state and the induced voltage will be further described with reference to FIG. 7.

Figure 7:
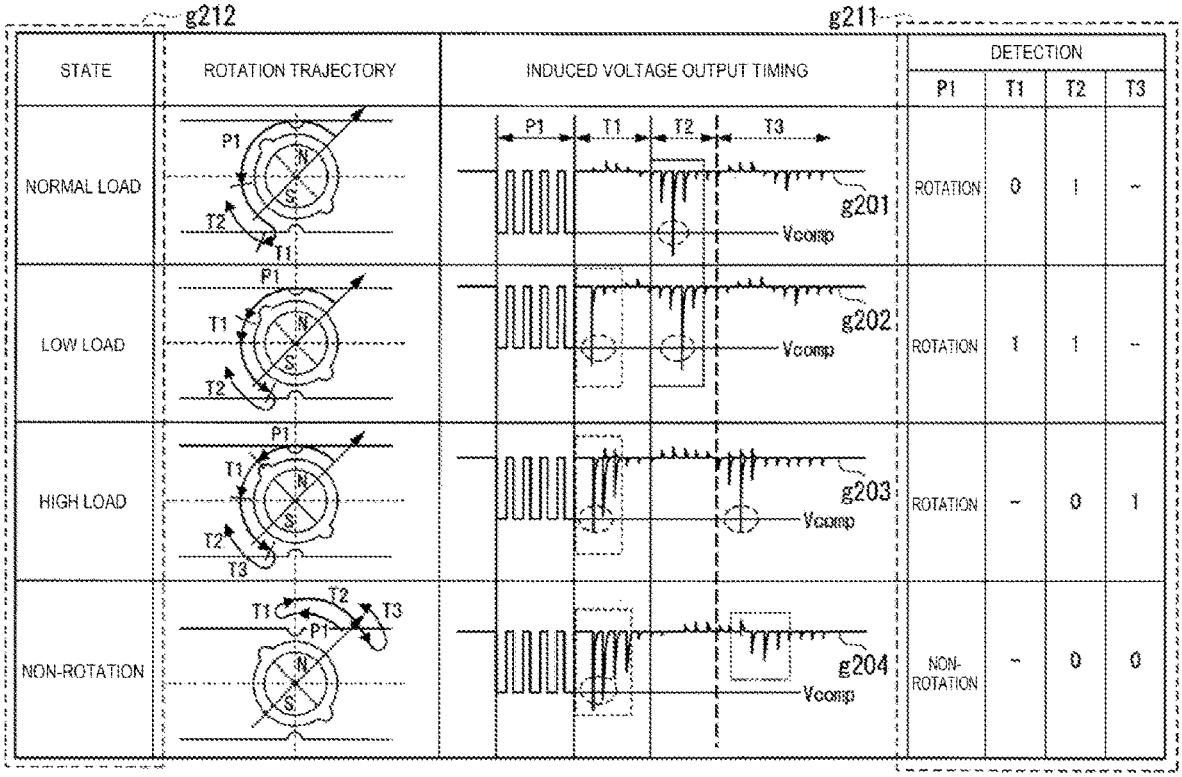
FIG. 7 is a view for describing a relationship between a load state and the induced voltage according to the first embodiment.

FIG. 7 is a view for describing the relationship between the load state and the induced voltage according to the present embodiment. In FIG. 7, a reference numeral P1 indicates the drive pulse P1. A reference numeral T1 indicates the section T1. A reference numeral T2 indicates the section T2. A reference numeral T3 indicates the section T3. Waveforms g201 to g204 show a schematic combination between a signal CO1 input to the comparator Q7 and the drive pulse P1.

In a case where the load applied to the motor 20 is normal (normal load), as illustrated by the waveform g201, in the section T2, the induced voltage signal VRs is equal to or greater than the reference voltage Vcomp. Therefore, an output of the comparator Q7 is "0" in the section T1, "1" in the section T2, and "–" in the section T3. Here, "–" indicates that the output may be "0" or may be "1".

In a case where the load applied to the motor 20 is low (low load), as illustrated by the waveform g202, in the section T1 and the section T2, the induced voltage signal VRs is equal to or greater than the reference voltage Vcomp. Therefore, the output of the comparator Q7 is "1" in the section T1, "1" in the section T2, and "–" in the section T3.

In a case where the load applied to the motor 20 is high (high load), as illustrated by the waveform g203, in the section T1 and the section T3, the induced voltage signal VRs is equal to or greater than the reference voltage Vcomp. Therefore, the output of the comparator Q7 is "–" in the section T1, "0" in the section T2, and "1" in the section T3.

In a case where the motor 20 is not rotated (non-rotation), as illustrated by the waveform g204, in the section T1, the induced voltage signal VRs is equal to or greater than the reference voltage Vcomp. Therefore, the output of the comparator Q7 is "–" in the section T1, "0" in the section T2, and "0" in the section T3.

In a case where a non-rotation state is detected at the main drive pulse P1, the pulse control unit 11 controls the motor 20 to be rotationally driven using the auxiliary drive pulse P2 having the polarity the same as that of the main drive pulse P1.

That is, it is possible to detect the load state or the non-rotation state of the motor 20 by combining the outputs in the sections T1 to T3 of the comparator Q7 with each other.

The storage unit 5 stores data by associating the output of the comparator Q7 in the sections T1 to T3 of the region surrounded by a reference numeral g211 in FIG. 7 with the load state or the rotation state of the region surrounded by a reference numeral g212.

Next, a schematic procedure will be described. In the procedure, the control unit 10 changes a pulse magnitude (pulse duty) of the drive pulse P1 serving as the comb tooth wave so as to detect an indicating hand position, based on the output of the comparator Q7 at that time.

Figure 8:
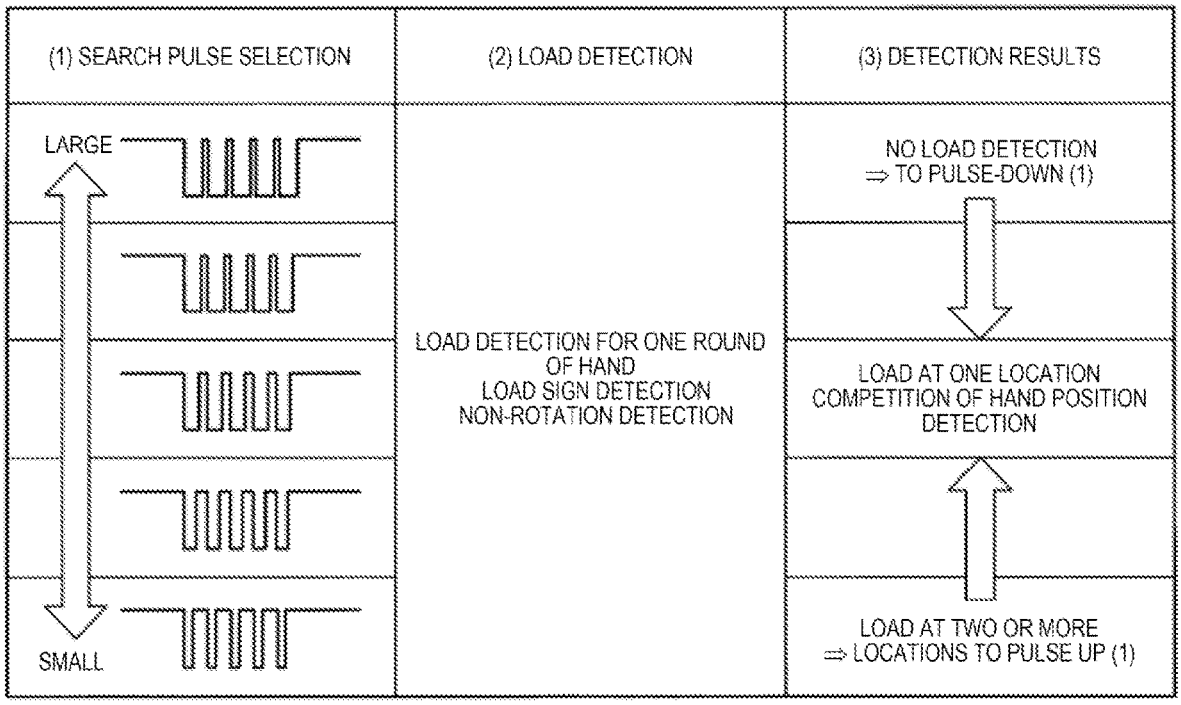
FIG. 8 is a view for schematically describing a procedure of detecting an indicating hand position according to the first embodiment.

FIG. 8 is a view for describing the schematic procedure of detecting the indicating hand position according to the present embodiment. The control unit 10 performs the following process in a hand position detection operation mode for detecting the position of the indicating hand 40, for example, when the battery 2 is replaced, when the power is brought into the ON-state for the first time, at every predetermined time (for example, once a day), or when settings are initialized. The search pulse used for detecting the reference position of the indicating hand 40 is stored in the storage unit 5. As illustrated in FIG. 8, the search pulse is the main drive pulse for detecting the reference position. The search pulse is configured to include a plurality of pulses having different pulse magnitudes (duties). The search pulse is the detection drive pulse based on the main drive pulse.

The pulse control unit 11 outputs the pulse signal corresponding to one round of the indicating hand 40 to the indicating hand drive unit 121, based on an initial value of the main drive pulse P1.

The pulse control unit 11 acquires the output of the comparator Q7 as much as one round of the indicating hand 40 in the sections T1 to T3 after the pulse signal is output. For example, in a case where the indicating hand 40 is the second hand, the pulse control unit 11 controls the comparator Q7 to output the pulse signal 60 times. Each time the pulse is output, the pulse control unit 11 stores the output of the comparator Q7 in the sections T1 to T3 in the storage unit 5. Specifically, the pulse control unit 11 stores the output by associating the first pulse with "0" in the section T1, "1" in the section T2, and "0" in the section T3, and associating the second pulse with "0" in the section T1, "1" in the section T2, and "0" in the section T3. The subsequent pulses are stored in the same manner.

The pulse control unit 11 compares a combination of the acquired outputs of the comparator Q7 in the sections T1 to T3 with a pattern of the outputs of the comparator Q7 in the sections T1 to T3 which are stored in the storage unit 5, and detects a state of the motor 20. The state of the motor 20 means whether or not the motor 20 has a low load (load is low), whether or not the motor 20 has a high load (load is high), and whether or not the motor 20 is in a non-rotation state.

The pulse control unit 11 changes a magnitude of the main drive pulse, based on a detection result. In the present embodiment, a process of lengthening an L-level of the pulse in the main drive pulse or a process of lengthening a pulse width will be referred to as pulse-up (PULSE-UP). In the present embodiment, a process of reducing the length of the L-level of the pulse in the drive pulse or a process of shortening the pulse width will be referred to as pulse-down (PULSE-DOWN).

The pulse control unit 11 changes the magnitude of the pulse so as to change an output state of the comparator Q7 for each position of the indicating hand 40 in one round (360 degrees) of the indicating hand 40.

In a case where there is no configuration element which changes the load received by the rotor 202 in the train wheel 30, during one round of the indicating hand 40, a normal load state ("0" in the section T1, "1" in the section T2, and "0" in the section T3) described in FIG. 7 is repeated 60 times.

In the present embodiment, as described above, a configuration element (reference load unit) which changes the load received by the rotor 202 is present in the train wheel 30. Accordingly, the train wheel 30 is formed so that the load received by the rotor 202 fluctuates at one location while the indicating hand 40 is rotated 360 degrees. Therefore, even in the normal state, if the magnitude of the search pulse is proper, the load is high at a position where the configuration element which changes the load received by the rotor 202 is present in the train wheel 30. Accordingly, the section T2 shows "0", and the section T3 shows "1". In this way, in a case where the load is high at one location in one round of the indicating hand 40, the location is the detection position of the indicating hand. Specifically, a position where it is detected that the section T2 shows "0" and the section T3 shows "1" is the reference position. In the present embodiment, in this way, detecting the position where the load is high will be referred to as hand position detection.

In a case where the pulse excessively becomes larger (length of the L-level of the pulse is increased), the rotor 202 is likely to be rotated. Accordingly, load is less likely to be detected, and the reference position is less likely to be detected. In this way, in a case where the load is no longer detected, the pulse control unit 11 performs the pulse-down.

On the other hand, in a case where the pulse excessively becomes small (length of the L-level length of the pulse is decreased), the rotor 202 is less likely to be rotated, and the load increases. Accordingly, a high load state occurs multiple times. In this way, in a case where the load is detected twice or more times, the pulse control unit 11 performs the pulse-up.

In this manner, according to the present embodiment, the indicating hand 40 is operated one round (360 degrees) so as to acquire detection results in the sections T1 to T3 during the indicating hand operation. Based on the acquired results, the reference position of the indicating hand 40 can be detected. In the present embodiment, it is desirable to perform the hand position detection by using the main drive pulse which does not bring the indicating hand 40 into a non-rotation state even in a case where the pulse-down is performed.

Next, a processing procedure example for performing the hand position detection will be described.

Figure 9:
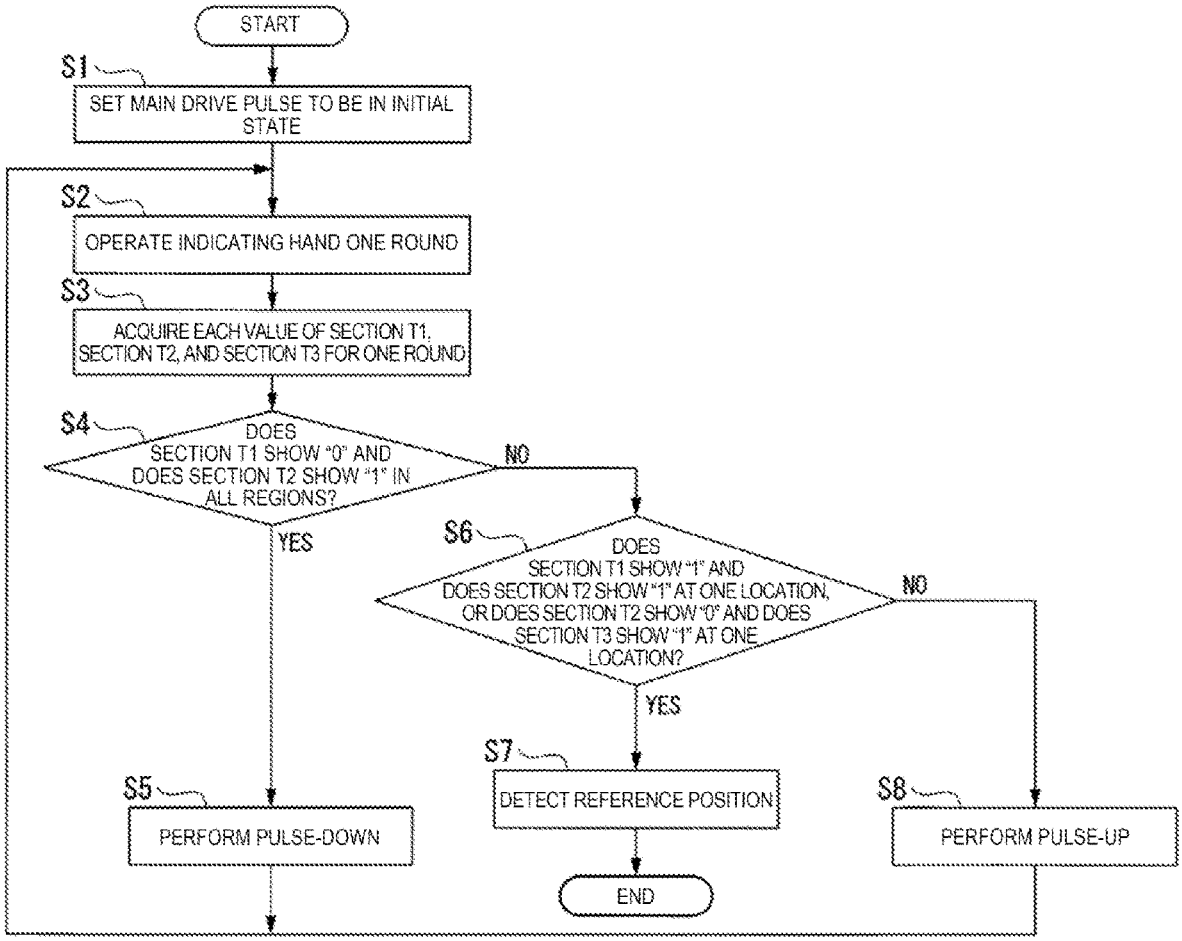
FIG. 9 is a flowchart illustrating a processing procedure example of detecting a hand position according to the first embodiment.

FIG. 9 is a flowchart illustrating the processing procedure example for performing the hand position detection according to the present embodiment. Referring to an example illustrated in FIG. 9, an example will be described in which the load at the reference position is higher than the load at the other position.

(Step S1) The pulse control unit 11 sets the main drive pulse to be in an initial state.

(Step S2) The pulse control unit 11 generates the main drive pulse so that the indicating hand 40 is operated one round (360 degrees). Based on the generated main drive pulse, the pulse control unit 11 controls the indicating hand drive unit 121. Subsequently, the indicating hand drive unit 121 drives the motor 20 so that the indicating hand 40 is operated one round (360 degrees).

(Step S3) The pulse control unit 11 acquires the output of the motor load detection unit 122 in each of the section T1, the section T2, and the section T3 for one round. Each time the pulse is output, the pulse control unit 11 stores the output of the motor load detection unit 122 in each of the sections T1 to T3 in the storage unit 5.

(Step S4) After the indicating hand operation for one round is completed, the pulse control unit 11 identifies whether or not the section T1 shows "0" and the section T2 shows "1" in all of the regions (one round of 0 to 359 degrees). In a case where the pulse control unit 11 identifies that the section T1 shows "0" and the section T2 shows "1" in all of the regions (Step S4; YES), the pulse control unit 11 proceeds to the process in Step S5. In a case where the section T1 does not show "0" and the section T2 does not show "1" in all of the regions (Step S4; NO), the process proceeds to the process in Step S6.

(Step S5) In a case where the section T1 shows "0" and the section T2 shows "1" in all of the regions, all of the regions are in the normal load state. There is enough room for rotation, and in this state, the load cannot be detected. In this case, in order to easily detect the load, it is necessary to make the rotation difficult. Therefore, the pulse control unit 11 performs the pulse-down as much as one pulse. That is, the pulse control unit 11 decreases the length of the L-level of the main drive pulse as much as one level. In other words, the pulse control unit 11 sets first energy to second energy which is lower than the first energy. For example, the pulse control unit 11 shortens the length of the L-level of the main drive pulse as much as one clock based on the frequency generated by the frequency divider circuit 4. After the process is performed, the pulse control unit 11 returns to the process in Step S2.

(Step S6) In a case where the section T1 shows "1" and the section T2 shows "1" at one location (one region) or in a case where the section T2 shows "0" and the section T3 shows "1" at one location (one region) (Step S6; YES), the pulse control unit 11 proceeds to the process in Step S7. In a case where the section T1 shows "1" and the section T2 shows "1" at a plurality of locations (a plurality of regions) or in a case where the section T2 shows "0" and the section T3 shows "1" at the plurality of locations (the plurality of regions) (Step S6; NO), the pulse control unit 11 proceeds to the process in Step S8.

(Step S7) In the case where the section T1 shows "1" and the section T2 shows "1" at one location (one region) or in the case where the section T2 shows "0" and the section T3 shows "1" at one location (one region), the pulse control unit 11 specifies a position where the load is detected, as the reference position, and stores the reference position in the storage unit 5. After the reference position is specified, the pulse control unit 11 stores the main drive pulse which is a search pulse when the reference position is specified, as an optimal pulse in the storage unit 5, and completes the process for the hand position detection. The pulse control unit 11 may use the drive pulse when the reference position is specified in this way, for the drive pulse in the normal indicating hand operation.

(Step S8) In the case where the section T1 shows "1" and the section T2 shows "1" at the plurality of locations (the plurality of regions) or in the case where the section T2 shows "0" and the section T3 shows "1" at the plurality of locations (the plurality of regions), the pulse control unit 11 performs the pulse-up as much as one pulse. That is, the pulse control unit 11 increases the length of the L-level of the main drive pulse as much as one level. In other words, the pulse control unit 11 sets the first energy to the third energy higher than the first energy. For example, the pulse control unit 11 increases the length of the L-level of the main drive pulse as much as one clock based on the frequency generated by the frequency divider circuit 4. After the process is performed, the pulse control unit 11 returns to the process in Step S2.

In a case where the reference position cannot be detected using the main drive pulse since there is a relatively great difference in the loads between the reference position and the normal position due to manufacturing variations, the pulse control unit 11 detects the reference position by using the auxiliary drive pulse, and stores the reference position in the storage unit 5. In this way, in a case where the reference position is detected using the auxiliary drive pulse (the section T2 shows "0" and the section T3 shows "0"), the pulse control unit 11 may not store the main drive pulse and the auxiliary drive pulse which enable the reference position to be detected, as the optimal pulse in the storage unit 5.

In the process in FIG. 9, a position having many loads may be present across two or more steps of the indicating hand 40, in some cases. However, in a case where two or more loads are consecutively obtained, the pulse control unit 11 detects a position corresponding to the output number of the pulses from which the load is detected for the first time, as the reference position. The position having many loads or the position from which the load is detected means a position where the section T1 shows "1" and the section T2 shows "1" or a position where the section T2 shows "0" and the section T3 shows "1".

Here, a schematic process illustrated in FIG. 9 will be described.

The pulse control unit 11 uses the main drive pulse (first energy) in an initial state so that the indicating hand 40 is rotated one round. In this manner, the pulse control unit 11 acquires each value of the sections T1 to T3. The main drive pulse in the initial state means the main drive pulse used for the indicating hand operation, or the main drive pulse which enables the reference position to be previously detected.

When the indicating hand 40 is rotated one round by using the main drive pulse in the initial state, in a case where the pulse control unit 11 finds one location where the load increases, the pulse control unit 11 determines the location as the first region (FIG. 2), that is, the reference position.

In a case where the pulse control unit 11 uses the main drive pulse in the initial state and does not find any one location where the load increases, the pulse control unit 11 performs the pulse-down until the main drive pulse reaches a state where there is one location of a low load or a high load (FIG. 7). The main drive pulse subjected to the pulse-down is the second energy, and the main drive pulse further subjected to the pulse-down from the second energy is the third energy.

Furthermore, in a case where any one location cannot be found even if the pulse-down is performed until the main drive pulse reaches a state where there is one location of the low load or the high load, the pulse control unit 11 uses the auxiliary drive pulse so as to perform the pulse-down until there is one location in a state of non-rotation (FIG. 7).

The main drive pulse in the initial state is used so that the indicating hand 40 is rotated one round. As a result, in a case where the plurality of locations of the low load or the high load (FIG. 7) are found, the pulse control unit 11 detects the reference position by performing the pulse-up until the main drive pulse reaches a state where there is one location of the low load or the high load (FIG. 7).

The processing procedure described above is an example, and the processing procedure may be changed depending on applications. A lower limit may be set for the pulse-down, and an upper limit may be set for the pulse-up so that the upper and lower limits are stored in the storage unit 5 in advance. In a case where the upper and lower limits are stored in this way, and in a case where the pulse control unit 11 cannot find one position where the load increases even if the pulse control unit 11 performs the pulse-up to reach the upper limit, the pulse control unit 11 may detect the reference position by returning to the initial state again, or may notify a user of the detection result after determining that there is abnormality. Alternatively, in a case where the pulse control unit 11 cannot find one position where the load increases even if the pulse control unit 11 performs the pulse-down to reach the lower limit, the pulse control unit 11 may detect the reference position by returning to the initial state again, or may notify a user of the detection result after determining that there is abnormality.

Hereinafter, the train wheel 30 according to the first embodiment will be described in detail. In the following description, rotation when the indicating hand 40 is rotated clockwise in the rotation of the gear configuring the train wheel 30 will be referred to as forward rotation, and rotation when the indicating hand 40 is rotated counterclockwise will be referred to as rearward rotation. In each drawing, a rotation direction (forward rotation direction and first rotation direction) during the forward rotation in rotation directions of the gear configuring the train wheel 30 is indicated by an arrow Dn, a rotation direction (rearward rotation direction) during the rearward rotation is indicated by an arrow Dr.

Figure 10:
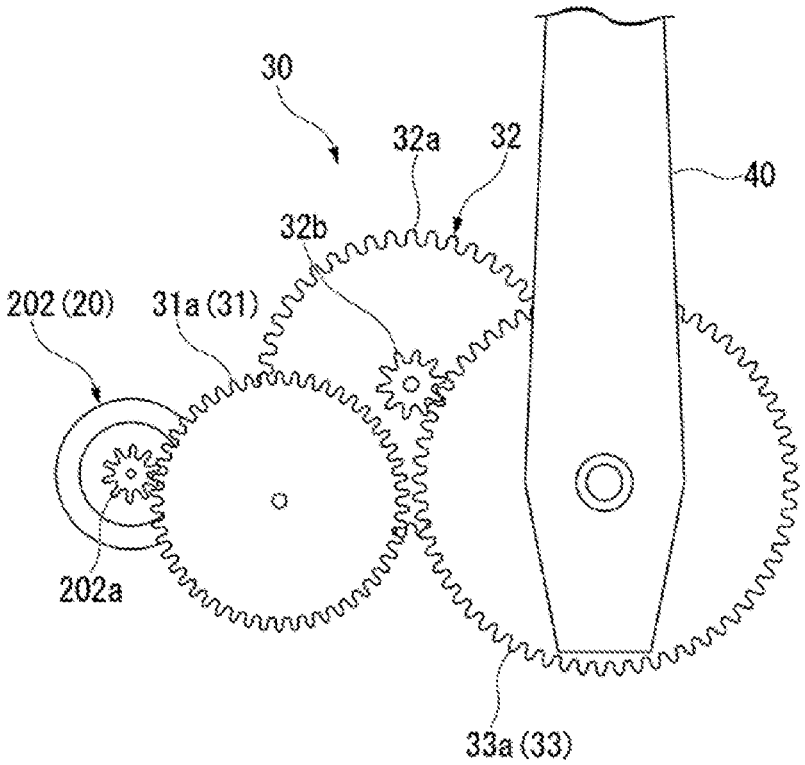
FIG. 10 is a plan view illustrating a train wheel according to the first embodiment.

FIG. 10 is a plan view illustrating the train wheel according to the first embodiment.

As illustrated in FIG. 10, the train wheel 30 includes a first intermediate wheel & pinion 31, a second intermediate wheel & pinion 32, and an indicating hand wheel & pinion 33. The first intermediate wheel & pinion 31 has a first intermediate gear 31*a* and a first intermediate pinion (not illustrated). The first intermediate gear 31*a* meshes with a pinion 202*a* of the rotor 202 of the motor 20. The second intermediate wheel & pinion 32 has a second intermediate gear 32*a* and a second intermediate pinion 32*b* (second gear). The second intermediate gear 32*a* meshes with a first intermediate pinion of the first intermediate wheel & pinion 31. The indicating hand wheel & pinion 33 has an indicating hand gear 33*a* (first gear) which meshes with a second intermediate pinion 32*b* of the second intermediate wheel & pinion 32. The indicating hand 40 is attached to the indicating hand wheel & pinion 33. In the following description, a radial direction of the indicating hand gear 33*a* will be simply referred to as a radial direction.

Figure 11:
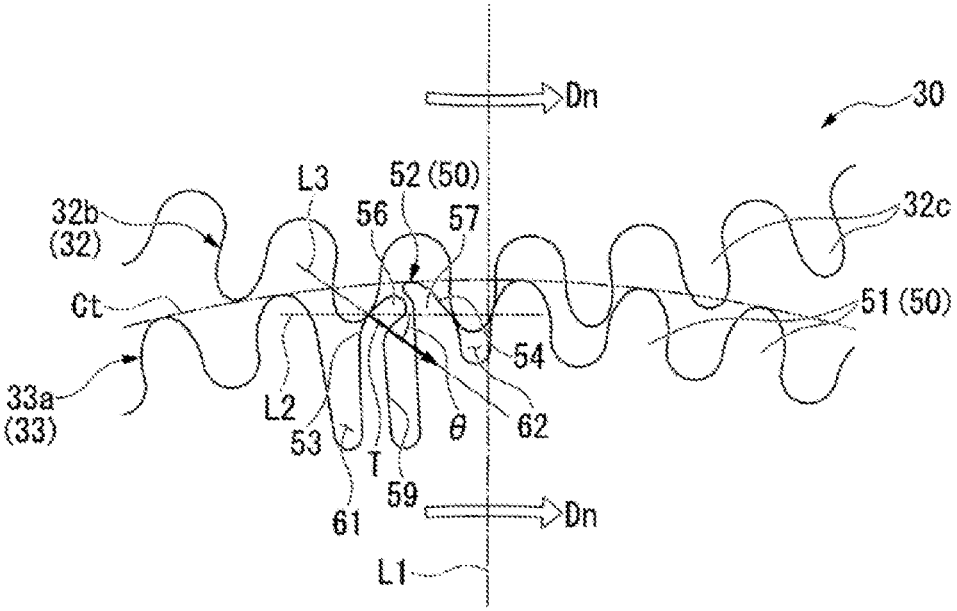
FIG. 11 is an enlarged view illustrating a meshing portion between an indicating hand gear and a second intermediate pinion in the train wheel according to the first embodiment.

FIG. 11 is an enlarged view illustrating a meshing portion between the indicating hand gear and the second intermediate pinion in the train wheel according to the first embodiment.

As illustrated in FIG. 11, the indicating hand gear 33*a* has a plurality of teeth 50. The plurality of teeth 50 of the indicating hand gear 33*a* are a standard tooth 51 and an elastic tooth 52. The standard tooth 51 is a tooth of a general gear, and is a tooth formed in an arc tooth shape, an involute tooth shape, or a cycloid tooth shape.

The elastic tooth 52 is one tooth of the plurality of teeth 50 belonging to the indicating hand gear 33*a*. The elastic tooth 52 is the above-described reference load unit, and increases the load received by the rotor 202 when the indicating hand 40 is located at the reference position. The elastic tooth 52 is provided with an elastic portion 56 formed to be elastically deformable and a rigid body 57 formed not to be elastically deformable. The elastic tooth 52 includes a first tooth surface 53 facing an upstream side in the forward rotation direction and a second tooth surface 54 facing a downstream side in the forward rotation direction. The first tooth surface 53 is formed from the elastic portion 56. The first tooth surface 53 is entirely located on the upstream side in the forward rotation direction from the tooth surface facing the upstream side in the forward rotation direction of the standard tooth 51. The second tooth surface 54 is formed from the rigid body 57. The second tooth surface 54 is entirely located on the downstream side in the forward rotation direction of the standard tooth 51 from the tooth surface facing the downstream side in the forward rotation direction. In this manner, a tooth thickness of the elastic tooth 52 is thicker than a tooth thickness of the standard tooth 51. A slit 59 extending inward in the radial direction from the vicinity of the tooth tip of the elastic tooth 52 is formed between the elastic portion 56 and the rigid body 57.

The elastic portion 56 is interposed between an upstream side tooth groove 61 and the slit 59 between the elastic tooth 52 and the standard tooth 51 on the upstream side in the forward rotation direction, which is one ahead of the elastic tooth 52. A dimension of the upstream side tooth groove 61 and the slit 59 is larger than a dimension of a tooth groove between the standard tooth 51 and the standard tooth 51 in the radial direction. In the illustrated example, each dimension is as large as approximately twice. In this manner, the elastic portion 56 has an aspect ratio higher than that of the standard tooth 51, and is elastically deformable in a circumferential direction of the indicating hand gear 33*a*. The elastic portion 56 extends along the radial direction from an inner end portion in the radial direction, and thereafter, extends while being bent outward in the radial direction and toward the downstream side in the forward rotation direction. An outer end edge in the radial direction in the elastic portion 56 is located further inside in the radial direction from a tooth tip circle Ct of the indicating hand gear 33*a*.

The rigid body 57 is interposed between a downstream side tooth groove 62 and the slit 59 between the elastic tooth 52 and the standard tooth 51 on the downstream side in the forward rotation direction, which is one ahead of the elastic tooth 52. The dimension of the tooth groove 62 on the downstream side is approximately the same as the dimension of the tooth groove between the standard tooth 51 and the standard tooth 51 in the radial direction. In this manner, the rigid body 57 has the aspect ratio lower than that of the elastic portion 56, and is not elastically deformable. The rigid body 57 extends along the radial direction from the inner end portion in the radial direction end, and thereafter, extends while being bent outward in the radial direction and toward the upstream side in the forward rotation direction. The outer end edge in the radial direction in the rigid body 57 is located on the tooth tip circle Ct of the indicating hand gear 33*a*. In this manner, the tooth tip of the elastic tooth 52 is formed from the rigid body 57.

Subsequently, a relationship between the indicating hand gear 33*a* and the second intermediate pinion 32*b* will be described.

First, an operation performed during the forward rotation of the train wheel 30 will be described.

The indicating hand wheel & pinion 33 is a passive side wheel & pinion relative to the second intermediate wheel & pinion 32. During the forward rotation, the tooth 32*c* of the second intermediate pinion 32*b* comes into contact with each tooth 50 of the indicating hand gear 33*a* from the upstream side in the forward rotation direction. When the tooth engaging with the second intermediate pinion 32*b* is switched from the standard tooth 51 to the elastic tooth 52, the tooth 32*c* of the second intermediate pinion 32*b* enters the upstream side tooth groove 61 between the elastic tooth 52 of the indicating hand gear 33*a* and the standard tooth 51 on the upstream side in the forward rotation direction, which is one ahead of the elastic tooth 52, and comes into contact with the first tooth surface 53 of the elastic tooth 52.

Figure 12:
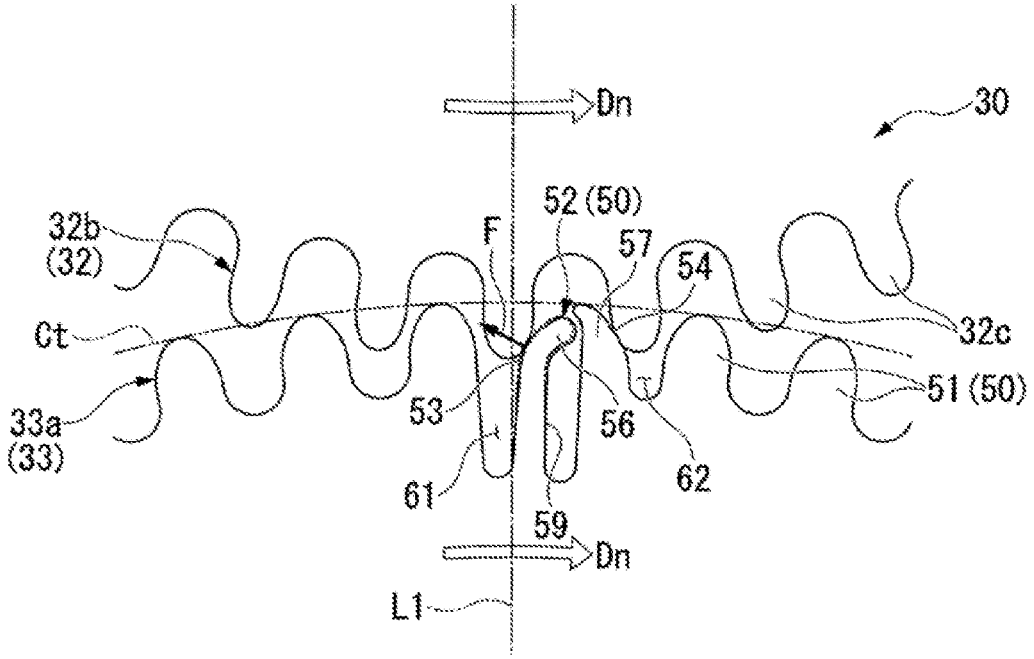
FIG. 12 is an enlarged view illustrating a meshing portion between the indicating hand gear and the second intermediate pinion in the train wheel according to the first embodiment.

FIG. 12 is an enlarged view illustrating a meshing portion between the indicating hand gear and the second intermediate pinion in the train wheel according to the first embodiment. FIG. 12 illustrates a state where the state in FIG. 11 is further rotated forward.

As illustrated in FIG. 12, after the tooth engaging with the second intermediate pinion 32*b* is switched to the elastic tooth 52 from the standard tooth 51, if the indicating hand gear 33*a* and the second intermediate pinion 32*b* are rotated forward, the tooth 32*c* of the second intermediate pinion 32*b* is separated from the standard tooth 51 on the downstream side in the forward rotation direction which is one ahead of the elastic tooth 52 of the indicating hand gear 33*a*. The tooth 32*c* of the second intermediate pinion 32*b* separated from the standard tooth 51 comes into contact with the second tooth surface 54 of the elastic tooth 52. In this manner, the elastic tooth 52 is interposed between the pair of teeth 32*c* of the second intermediate pinion 32*b* respectively from the downstream side and the upstream side in the forward rotation direction from the second intermediate pinion. If the elastic tooth 52 is interposed between the pair of the teeth 32*c* of the second intermediate pinion 32*b*, the elastic portion 56 is elastically deformed toward the rigid body 57 side. In this manner, the train wheel 30 has an energy loss caused by the elastic deformation of the elastic portion 56.

Thereafter, if the indicating hand gear 33*a* and the second intermediate pinion 32*b* are rotated forward, the tooth 32*c* of the second intermediate pinion 32*b* which comes into contact with the second tooth surface 54 of the elastic tooth 52 is separated from the second tooth surface 54 of the elastic tooth 52. In this manner, the forward rotation of the indicating hand gear 33*a* is not blocked by the elastic tooth 52 interposed between the pair of teeth 32*c* of the second intermediate pinion 32*b*. Accordingly, the indicating hand gear 33*a* can be rotated forward one or more rounds. The illustrated reference numeral F is a vector indicating a restoring force of the elastic portion 56 which acts on the second intermediate pinion 32*b* in the contact portion between the second intermediate pinion 32*b* and the elastic portion 56.

Here, referring to FIG. 11, a pressure angle θ will be defined. The pressure angle θ is an angle formed by a straight line L2 perpendicular to a center line L1 between the indicating hand gear 33*a* and the second intermediate pinion 32*b*, and a common normal line L3 of the tooth surface of each tooth of the indicating hand gear 33*a* and the second intermediate pinion 32*b* in the contact portion between the indicating hand gear 33*a* and the second intermediate pinion 32*b*. The common normal L3 extends parallel to a torque transmission direction T in the contact portion between the indicating hand gear 33*a* and the second intermediate pinion 32*b*.

Figure 13:
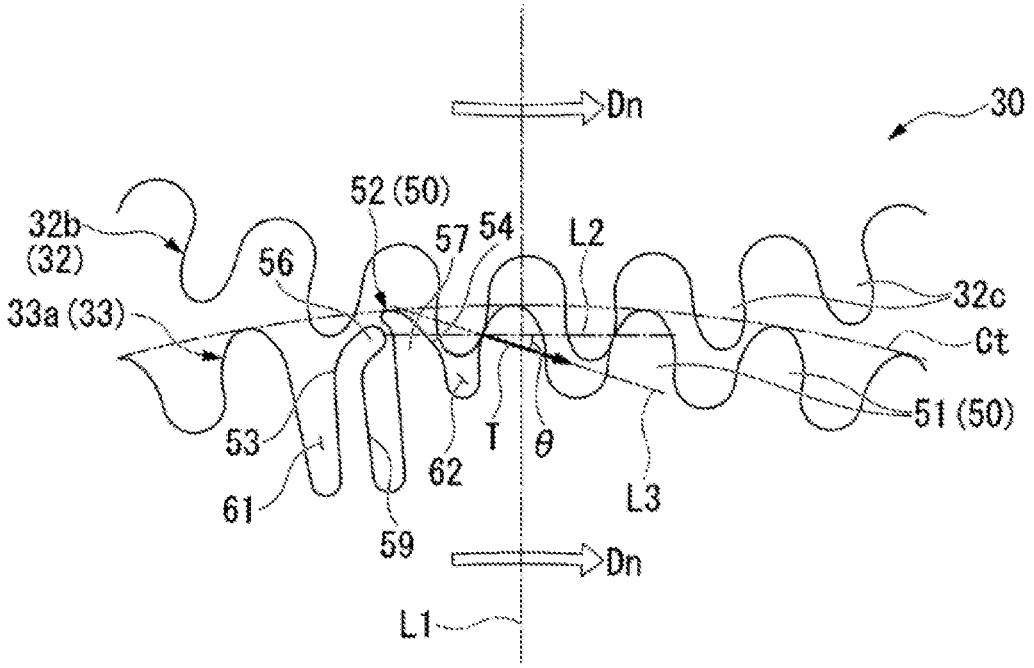
FIG. 13 is an enlarged view illustrating a meshing portion between the indicating hand gear and the second intermediate pinion in the train wheel according to the first embodiment.

FIG. 13 is an enlarged view illustrating a meshing portion between the indicating hand gear and the second intermediate pinion in the train wheel according to the first embodiment. FIG. 13 illustrates a state before the state illustrated in FIG. 11, and illustrates a state where the tooth engaging with the second intermediate pinion 32*b* is switched from the standard tooth 51 to the elastic tooth 52.

Here, as illustrated in FIG. 13, a state where the standard tooth 51 of the indicating hand gear 33*a* and the second intermediate pinion 32*b* engage with each other will be referred to as a standard tooth engagement state. As illustrated in FIGS. 11 and 12, a state where the elastic tooth 52 of the indicating hand gear 33*a* and the second intermediate pinion 32*b* engage with each other will be referred to as an elastic tooth engagement state. As illustrated in FIGS. 11 and 13, the pressure angle θ in the contact portion between the indicating hand gear 33*a* and the second intermediate pinion 32*b* in the elastic tooth engagement state during the forward rotation is larger than that in the standard tooth engagement state during the forward rotation. That is, the elastic tooth 52 is formed so that the torque transmission direction T in the contact portion between the indicating hand gear 33*a* and the second intermediate pinion 32*b* during the forward rotation is inclined larger to the straight line L2, compared to the standard tooth engagement state during an at least a partial period in the elastic tooth engagement state.

Next, an operation of the train wheel 30 during the rearward rotation will be described.

Figure 14:
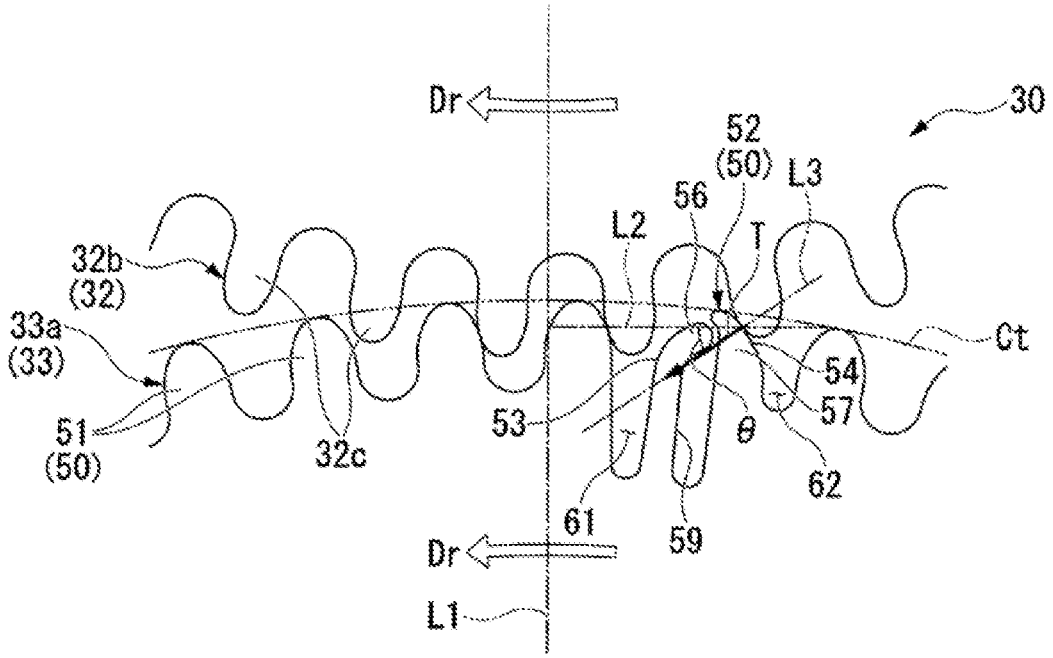
FIG. 14 is an enlarged view illustrating a meshing portion between the indicating hand gear and the second intermediate pinion in the train wheel according to the first embodiment.

FIG. 14 is an enlarged view illustrating a meshing portion between the indicating hand gear and the second intermediate pinion in the train wheel according to the first embodiment.

As illustrated in FIG. 14, during the rearward rotation, the tooth 32*c* of the second intermediate pinion 32*b* comes into contact with each tooth 50 of the indicating hand gear 33*a* from the upstream side in the rearward rotation direction. When the tooth engaging with the second intermediate pinion 32*b* is switched from the standard tooth 51 to the elastic tooth 52, the tooth 32*c* of the second intermediate pinion 32*b* enters the downstream side tooth groove 62 between the elastic tooth 52 of the indicating hand gear 33*a* and the standard tooth 51 on the upstream side in the rearward rotation direction which is one ahead of the elastic tooth 52, and comes into contact with the second tooth surface 54 of the elastic tooth 52.

Figure 15:
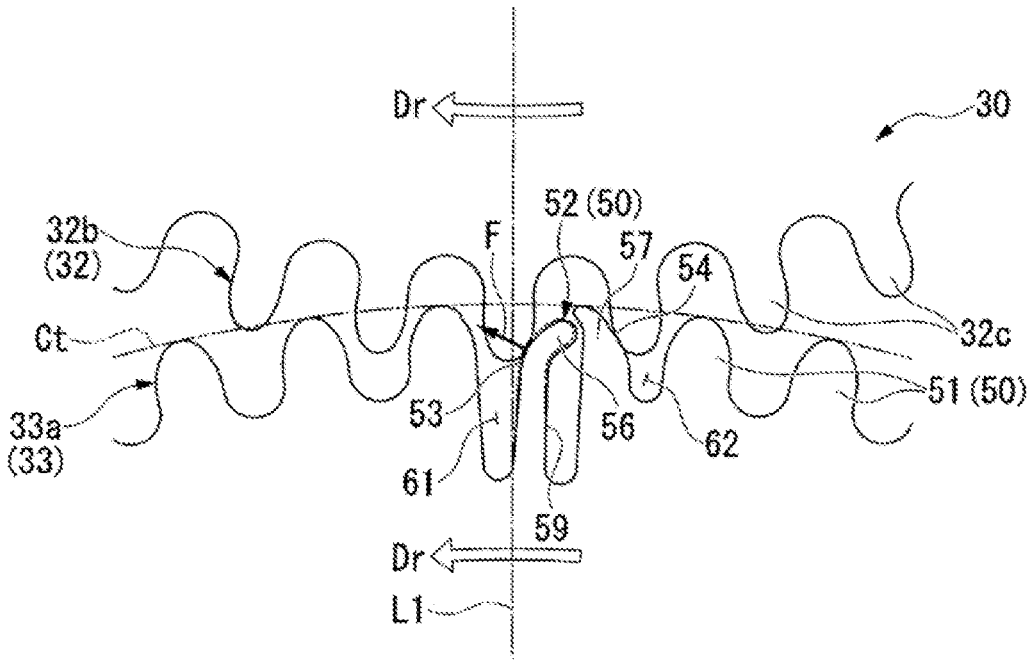
FIG. 15 is an enlarged view illustrating a meshing portion between the indicating hand gear and the second intermediate pinion in the train wheel according to the first embodiment.

FIG. 15 is an enlarged view illustrating a meshing portion between the indicating hand gear and the second intermediate pinion in the train wheel according to the first embodiment. FIG. 15 illustrates a state where the state in FIG. 14 is further rotated rearward.

As illustrated in FIG. 15, after the tooth engaging with the second intermediate pinion 32*b* is switched from the standard tooth 51 to the elastic tooth 52, if the indicating hand gear 33*a* and the second intermediate pinion 32*b* are rotated rearward, the tooth 32*c* of the second intermediate pinion 32*b* is separated from the standard tooth 51 on the downstream side in the rearward rotation direction which is one ahead of the elastic tooth 52 of the indicating hand gear 33*a*. The tooth 32*c* of the second intermediate pinion 32*b* separated from the standard tooth 51 comes into contact with the first tooth surface 53 of the elastic tooth 52. In this manner, the elastic tooth 52 is interposed between the pair of the teeth 32*c* of the second intermediate pinion 32*b* respectively from the downstream side and the upstream side in the rearward rotation direction. If the elastic tooth 52 is interposed between the pair of the teeth 32*c* of the second intermediate pinion 32*b*, the elastic portion 56 is elastically deformed toward the rigid body 57 side. In this manner, the train wheel 30 has the energy loss caused by the elastic deformation of the elastic portion 56.

Thereafter, if the indicating hand gear 33*a* and the second intermediate pinion 32*b* are rotated rearward, the tooth 32*c* of the second intermediate pinion 32*b* coming into contact with the first tooth surface 53 of the elastic tooth 52 is separated from the first tooth surface 53 of the elastic tooth 52. In this manner, the rearward rotation of the indicating hand gear 33*a* is not blocked by the elastic tooth 52 interposed between the pair of the teeth 32*c* of the second intermediate pinion 32*b*. Accordingly, the indicating hand gear 33*a* can be rotated rearward one or more rounds.

As illustrated in FIG. 14, the pressure angle θ in the contact portion between the indicating hand gear 33*a* and the second intermediate pinion 32*b* in the elastic tooth engagement state during the rearward rotation is smaller than that in the elastic tooth engagement state (refer to FIG. 11) during the forward rotation state. That is, the elastic tooth 52 is formed so that the torque transmission direction T in the contact portion between the indicating hand gear 33*a* and the second intermediate pinion 32*b* is inclined smaller to the straight line L2 in the elastic tooth engagement state during the rearward rotation, compared to the elastic tooth engagement state during the forward rotation.

In this way, the timepiece movement according to the present embodiment includes the control unit 10 which determines the reference position of the indicating hand 40 by detecting the rotation state of the rotor 202 when the indicating hand 40 is rotated using the detection drive pulse based on the main drive pulse. Accordingly, the means for grasping the reference position of the indicating hand 40 can also be realized using the predetermined load for enabling the normal hand operation. Furthermore, the timepiece movement includes the elastic portion 56 which is elastically deformed by coming into contact with the second intermediate pinion 32*b* when the indicating hand 40 disposed in the indicating hand gear 33*a* is located at the reference position. Therefore, when the indicating hand 40 is located at the reference position, the elastic portion 56 and the second intermediate pinion 32*b* come into contact with each other, and the elastic portion 56 is elastically deformed. Accordingly, the train wheel 30 has the energy loss caused by the elastic deformation of the elastic portion 56. In this manner, the rotation state of the rotor 202 can be changed when the indicating hand 40 is located at the reference position. Accordingly, the control unit 10 can determine the reference position of the indicating hand 40. Therefore, it is possible to provide the timepiece movement in which the means for grasping the reference position of the indicating hand 40 can also be realized using the predetermined load for enabling the normal hand operation.

Moreover, the elastic portion 56 is disposed in the indicating hand gear 33*a* belonging to the train wheel 30. Accordingly, it is not necessary to add a new component. Therefore, an increase in component cost can be suppressed.

Furthermore, the indicating hand gear 33*a* can be rotated one or more rounds in both the forward direction and the rearward direction. Accordingly, it is possible to avoid restriction in the rotation direction and the rotation range of the indicating hand 40. Therefore, the indicating hand 40 can be optionally rotated.

The indicating hand gear 33*a* includes the elastic tooth 52 which is the tooth 50 belonging to the indicating hand gear 33*a*, and has and the first tooth surface 53 facing the upstream side in the forward rotation direction of the indicating hand gear 33*a* and the second tooth surface 54 facing the downstream side in the forward rotation direction. The first tooth surface 53 of the elastic tooth 52 is formed from the elastic portion 56. According to this configuration, the tooth 32*c* of the second intermediate pinion 32*b* engages with the elastic tooth 52 from the upstream side in the forward rotation direction during the forward rotation of the indicating hand gear 33*a*. Accordingly, the elastic portion 56 is elastically deformed by coming into contact with the second intermediate pinion 32*b* during the forward rotation of the indicating hand gear 33*a*. Accordingly, the rotation state of the rotor 202 can be changed at least during the forward rotation. Therefore, the control unit 10 can determine the reference position of the indicating hand 40 during the forward rotation.

The second tooth surface 54 of the elastic tooth 52 is formed from the rigid body 57. According to this configuration, the second tooth surface 54 is not elastically displaced. Accordingly, in a state where the second intermediate pinion 32*b* engages with the second tooth surface 54, disengagement between the elastic tooth 52 and the second intermediate pinion 32*b* can be suppressed. Therefore, the indicating hand gear 33*a* and the second intermediate pinion 32*b* can accurately mesh with each other.

The elastic portion 56 is formed so that the torque transmission direction T in the contact portion between the second intermediate pinion 32*b* and the indicating hand gear 33*a* in the elastic tooth engagement state is inclined larger to the straight line L2, compared to that in the standard tooth engagement state. According to this configuration, transmission efficiency of the drive force of the motor 20 from the second intermediate pinion 32*b* to the indicating hand gear 33*a* in the elastic tooth engagement state becomes poorer than that in the standard tooth engagement state. Therefore, the rotation state of the rotor 202 can be changed by increasing the load received by the rotor 202 when the indicating hand 40 is located at the reference position.

In particular, according to the present embodiment, the elastic tooth 52 is formed so that the torque transmission direction T in the contact portion between the indicating hand gear 33*a* and the second intermediate pinion 32*b* in the elastic tooth engagement state during the rearward rotation is inclined smaller to the straight line L2, compared to that in the elastic tooth engagement state during the forward rotation. In this manner, the fluctuation in the load received by the rotor 202 during the rearward rotation is smaller than that during the forward rotation. Therefore, even in a case where the driving in the rearward direction of the motor 20 is more complicated than the driving in the forward direction, it is possible to suppress the inability to drive the motor 20 in the rearward direction. Therefore, the indicating hand 40 can be optionally rotated rearward.

The indicating hand 40 is attached to the indicating hand gear 33*a*. According to this configuration, the elastic tooth 52 can be displaced in synchronization with the indicating hand 40. Therefore, the reference position of the indicating hand 40 can be more accurately grasped, compared to a case where the elastic tooth is disposed in the gear other than the indicating hand gear 33*a* included in the train wheel 30 which is the same as the indicating hand gear 33*a*.

The elastic tooth 52 is one tooth of the plurality of teeth 50 belonging to the indicating hand gear 33*a*. Therefore, for example, compared to a case where the plurality of elastic teeth 52 are aligned with each other, it is possible to narrow an arrangement range of the indicating hand 40 when the load received by the rotor 202 fluctuates. Therefore, the reference position of the indicating hand 40 can be accurately grasped.

According to the first embodiment described above, the second tooth surface 54 of the elastic tooth 52 is formed from the rigid body 57. However, the embodiment is not limited thereto. At least one of the first tooth surface 53 and the second tooth surface 54 of the elastic tooth 52 may be formed from the elastic portion. That is, the second tooth surface 54 of the elastic tooth 52 may be formed from the elastic portion different from the elastic portion 56 for forming the first tooth surface 53.

According to the first embodiment described above, the first tooth surface 53 of the elastic tooth 52 is entirely located on the upstream side in the forward rotation direction from the tooth surface facing the upstream side in the forward rotation direction of the standard tooth 51. However, the embodiment is not limited thereto. The first tooth surface of the elastic tooth may be located at a position the same as that of the tooth surface facing the upstream side in the forward rotation direction of the standard tooth 51. The second tooth surface 54 of the elastic tooth 52 may be located in the same manner.

Second Embodiment

Figure 16:
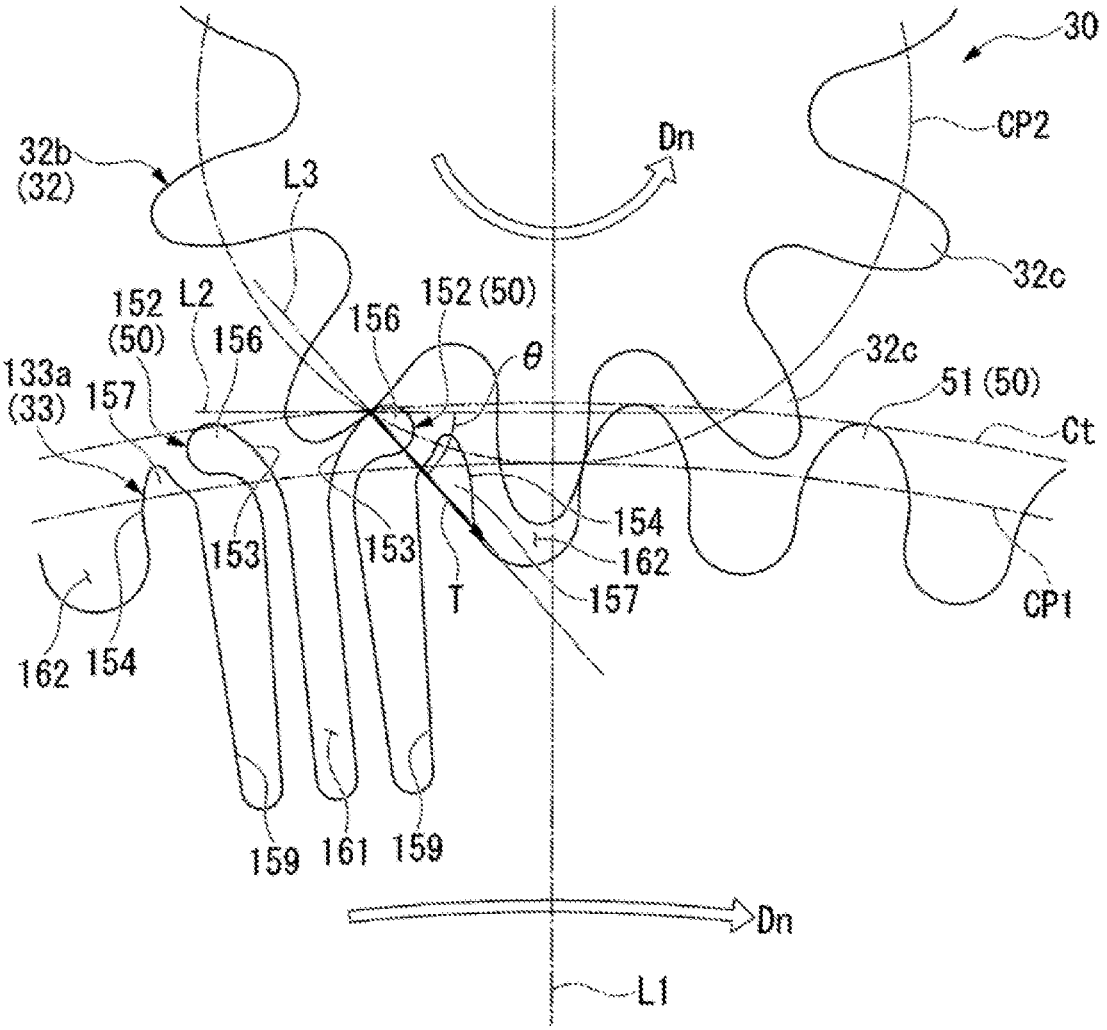
FIG. 16 is an enlarged view illustrating a meshing portion between an indicating hand gear and a second intermediate pinion in a train wheel according to a second embodiment.

FIG. 16 is an enlarged view illustrating a meshing portion between an indicating hand gear and a second intermediate pinion in a train wheel according to a second embodiment.

The second embodiment illustrated in FIG. 16 is different from the first embodiment in that a pair of teeth 50 adjacent to each other in a plurality of teeth 50 belonging to an indicating hand gear 133*a* is an elastic tooth 152.

As illustrated in FIG. 16, the elastic tooth 152 increases the load received by the rotor 202 when the indicating hand 40 is located at the reference position, which is the above-described reference load unit. The elastic tooth 152 is provided with an elastic portion 156 which is elastically deformable and a rigid body 157 which is not elastically deformable. Each of the pair of elastic teeth 152 includes first tooth surfaces 153 (facing tooth surfaces) facing each other in the circumferential direction of the indicating hand gear 133*a* and second tooth surfaces 154 facing sides opposite to the first tooth surfaces 153. The first tooth surface 153 is formed from the elastic portion 156. The second tooth surface 154 is formed from the rigid body 157. A slit 159 extending inward in the radial direction from the vicinity of the tooth tip of the elastic tooth 152 is formed between the elastic portion 156 and the rigid body 157.

The elastic portion 156 is interposed between a tooth groove 161 between the pair of elastic teeth 152 and the slit 159. Each dimension of the tooth groove 161 and the slit 159 is larger than the dimension of the tooth groove between the standard tooth 51 and the standard tooth 51 in the radial direction, and is approximately twice in the illustrated example. In this manner, the elastic portion 156 has an aspect ratio higher than that of the standard tooth 51, and is elastically deformable in the circumferential direction of the indicating hand gear 133*a*. The elastic portion 156 extends along the radial direction from the inner end portion in the radial direction, and thereafter, extends while being bent in the direction away from the adjacent elastic tooth 152 in the circumferential direction of the indicating hand gear 133*a* and outward in the radial direction. The outer end edge in the radial direction in the elastic portion 156 is located on the tooth tip circle Ct of the indicating hand gear 133*a*. In this manner, the tooth tip of the elastic tooth 152 is formed from the elastic portion 156.

The rigid body 157 is interposed between the tooth groove 162 between the elastic tooth 152 and the standard tooth 51 and the slit 159. The dimension of the tooth groove 162 is approximately the same as the dimension of the tooth groove between the standard tooth 51 and the standard tooth 51 in the radial direction. In this manner, the rigid body 157 has the aspect ratio lower than that of the elastic portion 156, and is not elastically deformable. The rigid body 157 extends along the radial direction from the inner end portion in the radial direction. The tip portion of the rigid body 157 is tapered so as to avoid contact with the elastically deformable elastic portion 156. The outer end edge in the radial direction in the rigid body 157 is located inward in the radial direction from the tooth tip circle Ct of the indicating hand gear 133*a*.

The width of the tooth groove 161 between the pair of elastic teeth 152 is smaller than the tooth thickness of the tooth 32*c* of the second intermediate pinion 32*b*. The width of the tooth groove 161 represents the distance between the pair of elastic teeth 152 on a pitch circle CP1 of the indicating hand gear 133*a*. The tooth thickness of the tooth 32*c* represents the thickness of the tooth 32*c* on a pitch circle CP2 of the second intermediate pinion 32*b*. In this manner, if the tooth 32*c* of the second intermediate pinion 32*b* enters the tooth groove 161 between the pair of elastic teeth 152, the tooth 32*c* of the second intermediate pinion 32*b* comes into contact with the first tooth surface 153 (that is, the pair of elastic portions 156) of the pair of elastic teeth 152.

Subsequently, a relationship between the indicating hand gear 133*a* and the second intermediate pinion 32*b* will be described.

The indicating hand gear 133*a* according to the present embodiment is symmetrically formed in the circumferential direction. Accordingly, the indicating hand gear 133*a* and the second intermediate pinion 32*b* are similarly operated during the forward rotation and the rearward rotation of the train wheel 30. Therefore, an operation of the train wheel 30 during the forward rotation will be described below.

When the tooth engaging with the second intermediate pinion 32*b* is switched from the standard tooth 51 to the elastic tooth 152, the tooth 32*c* of the second intermediate pinion 32*b* enters the tooth groove 161 between the pair of elastic teeth 52 of the indicating hand gear 133*a*, and comes into contact with the first tooth surface 153 of the elastic tooth 152 on the downstream side in the forward rotation direction.

The pressure angle θ in the contact portion between the indicating hand gear 133*a* and the second intermediate pinion 32*b* in the elastic tooth engagement state is larger than that in the standard tooth engagement state. That is, the elastic tooth 152 is formed so that the torque transmission direction T in the contact portion between the indicating hand gear 133*a* and the second intermediate pinion 32*b* is inclined larger to the straight line L2, compared to that in the standard tooth engagement state during at least a partial period in the elastic tooth engagement state.

Figure 17:
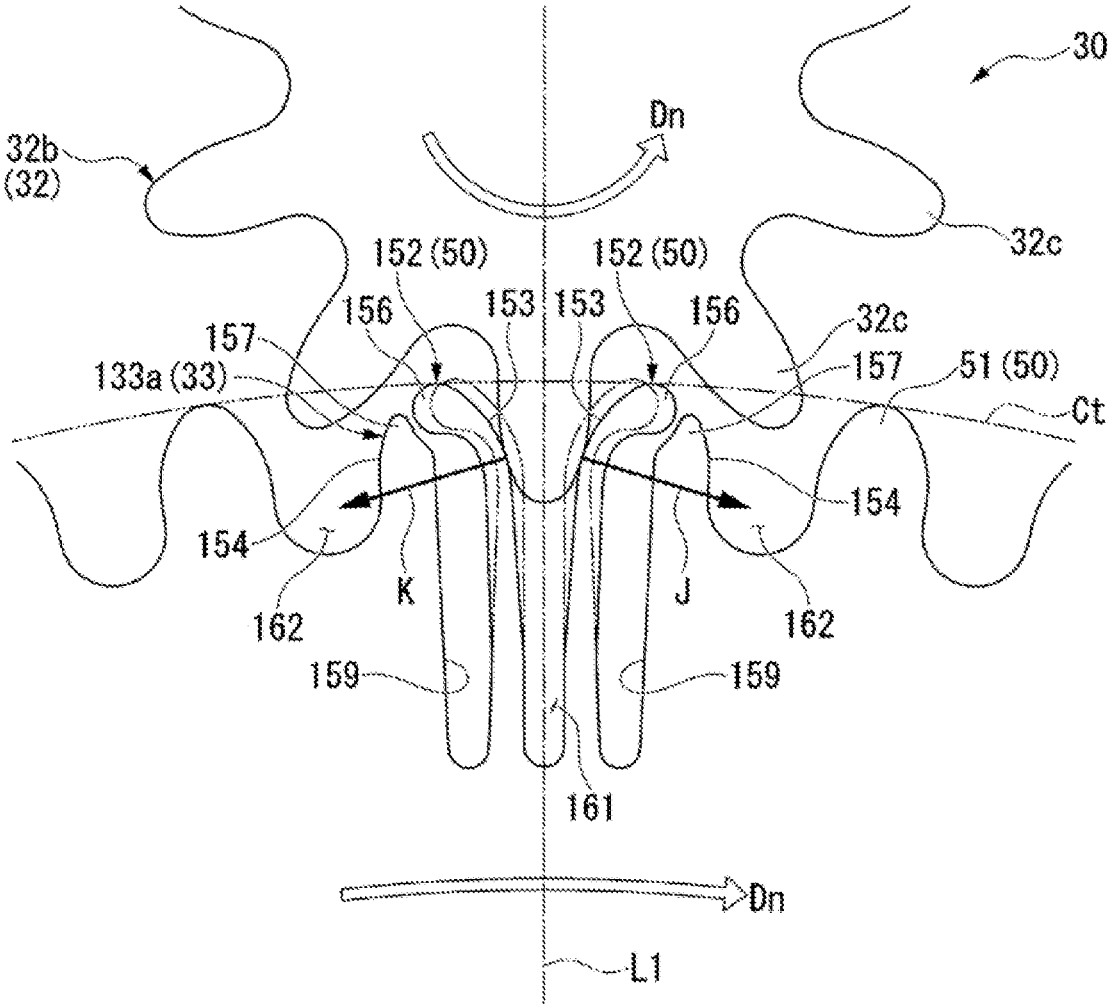
FIG. 17 is an enlarged view illustrating a meshing portion between the indicating hand gear and the second intermediate pinion in the train wheel according to the second embodiment.

FIG. 17 is an enlarged view illustrating a meshing portion between the indicating hand gear and the second intermediate pinion in the train wheel according to the second embodiment. FIG. 17 illustrates a state where the second intermediate pinion 32*b* is interposed between the pair of elastic portions 156 of the indicating hand gear 133*a*, which is a state where the state in FIG. 16 is further rotated forward.

As illustrated in FIG. 17, after the tooth engaging with the second intermediate pinion 32*b* is switched from the standard tooth 51 to the elastic tooth 152, if the indicating hand gear 133*a* and the second intermediate pinion 32*b* are rotated forward, the tooth 32*c* of the second intermediate pinion 32*b* comes into contact with the pair of the elastic portions 156. In this case, forces are applied to the pair of elastic portions 156 in directions indicated by the reference numerals J and K, and the pair of elastic portions 156 are elastically deformed so as to be separated from each other due to the forces. In this manner, the train wheel 30 has the energy loss caused by the elastic deformation of the pair of elastic portions 156.

In this way, the timepiece movement according to the present embodiment includes the train wheel 30 having the indicating hand gear 133*a* and the second intermediate pinion 32*b* which transmit the driving force of the motor 20 to the indicating hand 40 and which mesh with each other, and the elastic portion 156 which is disposed in the indicating hand gear 133*a* and which is elastically deformed by coming into contact with the second intermediate pinion 32*b* when the indicating hand 40 is located at the reference position. According to this configuration, similar to the first embodiment, it is possible to provide the timepiece movement in which the means for grasping the reference position of the indicating hand 40 can also be realized using the predetermined load for enabling the normal hand operation.

The indicating hand gear 133*a* includes the pair of elastic teeth 152 adjacent to each other in the circumferential direction of the indicating hand gear 133*a*, which is the tooth 50 belonging to the indicating hand gear 133*a*. The width of the tooth groove 161 between the pair of elastic teeth 152 is smaller than the tooth thickness of the tooth 32*c* belonging to the second intermediate pinion 32*b*. Each of the pair of elastic teeth 152 has the first tooth surfaces 153 facing each other in the circumferential direction of the indicating hand gear 133*a*. The first tooth surface 153 is formed from the elastic portion 156. According to this configuration, the width of the tooth groove 161 between the pair of elastic teeth 152 is smaller than the tooth thickness of the tooth 32*c* of the second intermediate pinion 32*b*. Accordingly, when the tooth 32*c* of the second intermediate pinion 32*b* enters the tooth groove 161 between the pair of elastic teeth 152, the tooth 32*c* of the second intermediate pinion 32*b* can be brought into contact with each first tooth surface 153 of the pair of elastic teeth 152. The first tooth surface 153 of the elastic tooth 152 is formed from the elastic portion 156. Accordingly, regardless of the rotation direction of the indicating hand gear 133*a*, the pair of elastic portions 156 is elastically deformed by coming into contact with the second intermediate pinion 32*b*. Therefore, it is possible to change the rotation state of the rotor 202 by elastically deforming the elastic portion 156. Therefore, regardless of the rotation direction of the indicating hand gear 133*a*, the rotation state of the rotor 202 can be changed by elastically deforming the elastic portion 156. Accordingly, during the forward rotation and the rearward rotation of the indicating hand gear 133*a*, the control unit 10 can determine the reference position of the indicating hand 40.

The indicating hand gear 133*a* includes the pair of elastic teeth 152 adjacent to each other. Accordingly, compared to the configuration in which the indicating hand gear has one elastic tooth, a time is lengthened when the elastic portion 156 is in contact with the tooth 32*c* belonging to the second intermediate pinion 32*b*. In this manner, the rotation state of the rotor 202 can be changed for a longer period of time. Therefore, the control unit 10 can achieve improved accuracy in detecting the reference position of the indicating hand 40.

Third Embodiment

Figure 18:
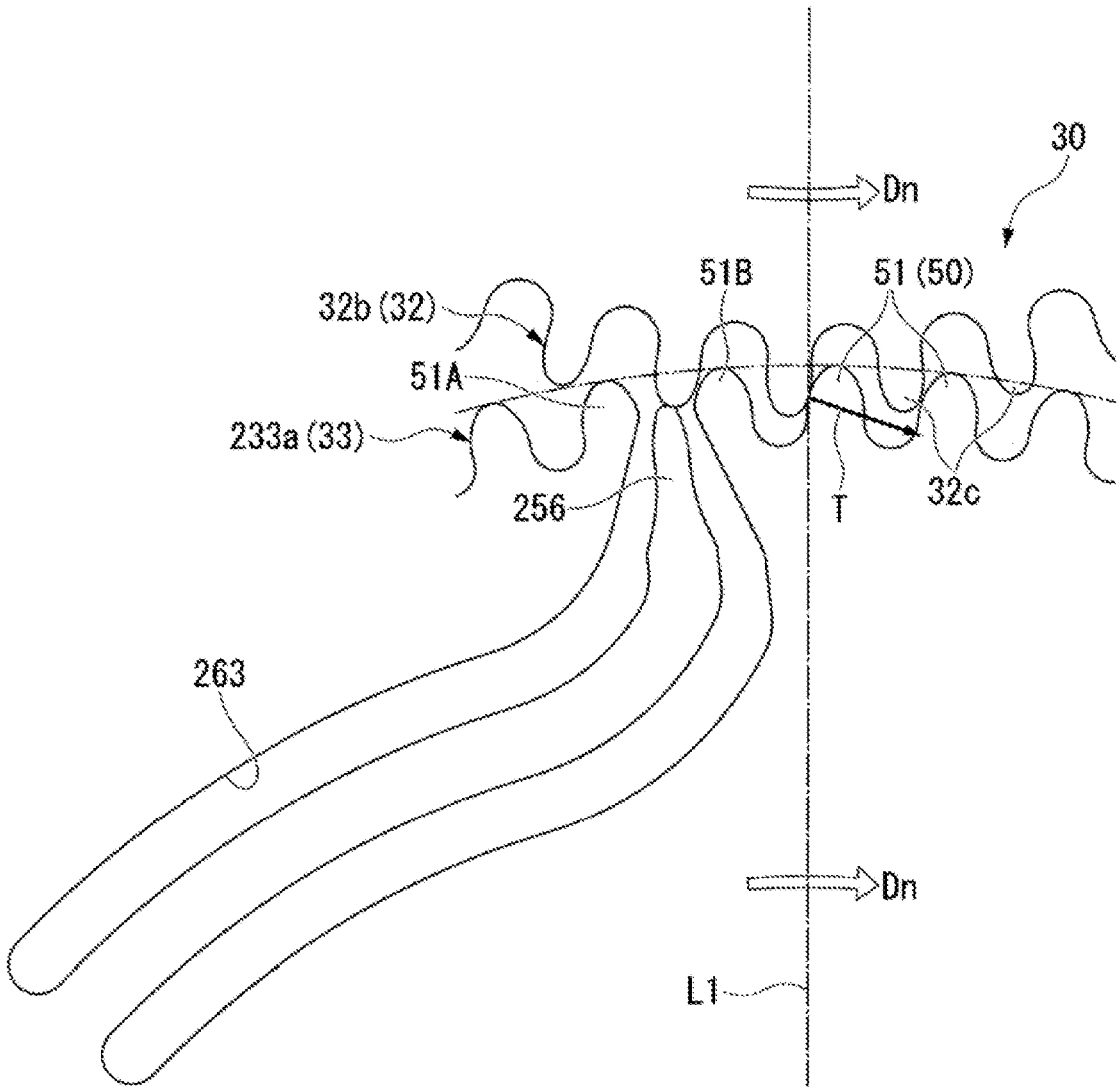
FIG. 18 is an enlarged view illustrating a meshing portion between an indicating hand gear and a second intermediate pinion in a train wheel according to a third embodiment.
Figure 19:
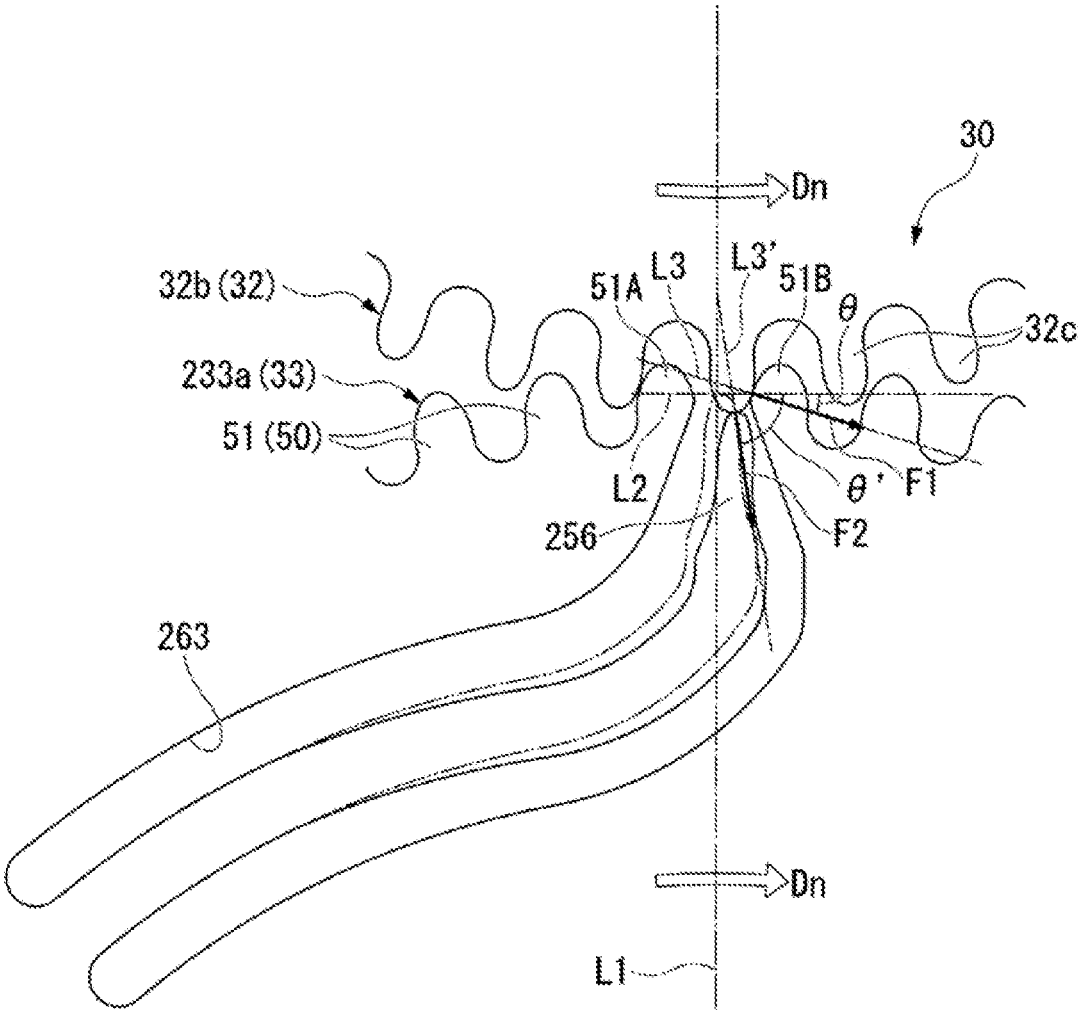
FIG. 19 is an enlarged view illustrating a meshing portion between the indicating hand gear and the second intermediate pinion in the train wheel according to the third embodiment.

FIGS. 18 and 19 are enlarged views illustrating a meshing portion between an indicating hand gear and a second intermediate pinion in a train wheel according to a third embodiment. FIG. 19 illustrates a state where the state in FIG. 18 is further rotated forward.

According to the first embodiment illustrated in FIG. 11, the elastic portion 56 is disposed so as to form the tooth surface of the elastic tooth 52. In contrast, the third embodiment illustrated in FIG. 18 is different from the first embodiment in that an elastic portion 256 is disposed separately from the tooth 50 of an indicating hand gear 233*a*.

As illustrated in FIG. 18, the indicating hand gear 233*a* has the plurality of teeth 50 and the elastic portion 256. The plurality of teeth 50 are respectively the standard teeth 51. The plurality of standard teeth 51 include a first standard tooth 51A (first tooth) and a second standard tooth 51B (second tooth) which are adjacent to each other. The first standard tooth 51A is located on the upstream side in the forward rotation direction which is one ahead of the second standard tooth 51B. A slit 263 is linked to the tooth groove between the first standard tooth 51A and the second standard tooth 51B. The slit 263 extends inward along the radial direction from the tooth groove between the first standard tooth 51A and the second standard tooth 51B, and thereafter, extends while being bent inward in the radial direction and toward the upstream side in the forward rotation direction.

The elastic portion 256 increases the load received by the rotor 202 when the indicating hand 40 is located at the reference position which is the above-described reference load unit. The elastic portion 256 is disposed in the slit 263. The elastic portion 256 is a cantilever beam extending from a portion connected to an innermost end of the slit 263 as a base end. The elastic portion 256 extends from the innermost end of the slit 263 along the extending direction of the slit 263 in a state of being separated from a side edge of the slit 263. Specifically, the elastic portion 256 extends outward in the radial direction from the base end and toward the downstream side in the forward rotation direction, and thereafter, extends outward in the radial direction and along the radial direction. That is, a portion of the elastic portion 256 extends along a direction intersecting the radial direction. As illustrated in FIG. 19, the elastic portion 256 is elastically deformed so that the tip (free end) is displaced inward in the radial direction while the base end is used as a fulcrum. The tip of the elastic portion 256 is located in the tooth groove between the first standard tooth 51A and the second standard tooth 51B.

Subsequently, a relationship between the indicating hand gear 233*a* and the second intermediate pinion 32*b* will be described.

First, an operation performed when the train wheel 30 is rotated forward will be described.

As illustrated in FIG. 18, during the forward rotation, before or after the timing at which the tooth engaging with the second intermediate pinion 32*b* is switched to the second standard tooth 51B, the tooth 32*c* of the second intermediate pinion 32*b* engaging with the second standard tooth 51B comes into contact with the tip of the elastic portion 256. Thereafter, as illustrated in FIG. 19, if the second intermediate pinion 32*b* engages with the second standard tooth 51B and the indicating hand gear 233*a* and the second intermediate pinion 32*b* are further rotated forward, the tooth 32*c* of the second intermediate pinion 32*b* is elastically deformed so as to push the elastic portion 256 inward in the radial direction. In this way, when the second standard tooth 51B and the second intermediate pinion 32*b* engage with each other, the elastic portion 256 comes into contact with the second intermediate pinion 32*b*. In this manner, the train wheel 30 has the energy loss caused by the elastic deformation of the elastic portion 256. During the forward rotation, the elastic portion 256 may come into contact with the tooth 32*c* of the second intermediate pinion 32*b* during at least a partial period in the engagement state between the second standard tooth 51B and the second intermediate pinion 32*b*.

Here, the tooth 32*c* of the second intermediate pinion 32*b* comes into contact with the tip of the elastic portion 256. Therefore, a pressure angle θ' in the contact portion between the elastic portion 256 and the second intermediate pinion 32*b* is larger than the pressure angle θ in the contact portion between the second standard tooth 51B and the second intermediate pinion 32*b*. The pressure angle θ' is an angle formed by the straight line L2 and a common normal line L3' of each contact surface of the elastic portion 256 and the second intermediate pinion 32*b* in the contact portion between the elastic portion 256 and the second intermediate pinion 32*b*. In this manner, a force acting direction F2 from the second intermediate pinion 32*b* acting on the elastic portion 256 is inclined larger to the straight line L2, compared to a force acting direction F1 from the second intermediate pinion 32*b* acting on the second standard tooth 51B. Therefore, the torque transmission direction of the entire contact portion between the indicating hand gear 233*a* and the second intermediate pinion 32*b* is inclined larger to the straight line L2, compared to the torque transmission direction T (refer to FIG. 18) in a state where the second intermediate pinion 32*b* is not in contact with the elastic portion 256 during the forward rotation. That is, during the forward rotation, the elastic portion 256 is formed so that the torque transmission direction in the entire contact portion between the indicating hand gear 233*a* and the second intermediate pinion 32*b* in a state where the second standard tooth 51B and the second intermediate pinion 32*b* engage with each other is inclined larger to the straight line L2, compared to that in a state where the standard tooth 51 other than the second standard tooth 51B and the second intermediate pinion 32*b* engage with each other. The torque transmission direction in the entire contact portion between the indicating hand gear 233*a* and the second intermediate pinion 32*b* coincides with a direction of the sum of a vector of a force acting in a direction indicated by the reference numeral F1 and a vector of a force acting in a direction indicated by the reference numeral F2.

Next, an operation performed when the train wheel 30 is rotated rearward will be described.

Figure 20:
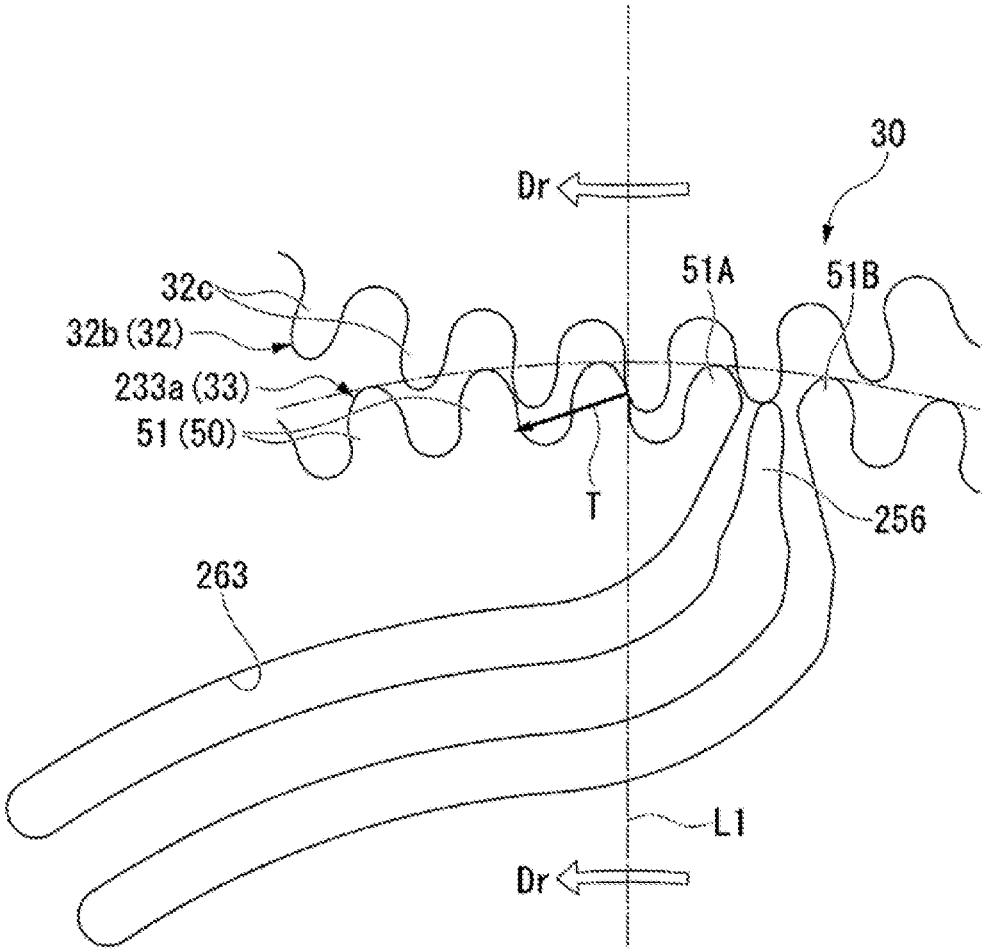
FIG. 20 is an enlarged view illustrating a meshing portion between the indicating hand gear and the second intermediate pinion in the train wheel according to the third embodiment.
Figure 21:
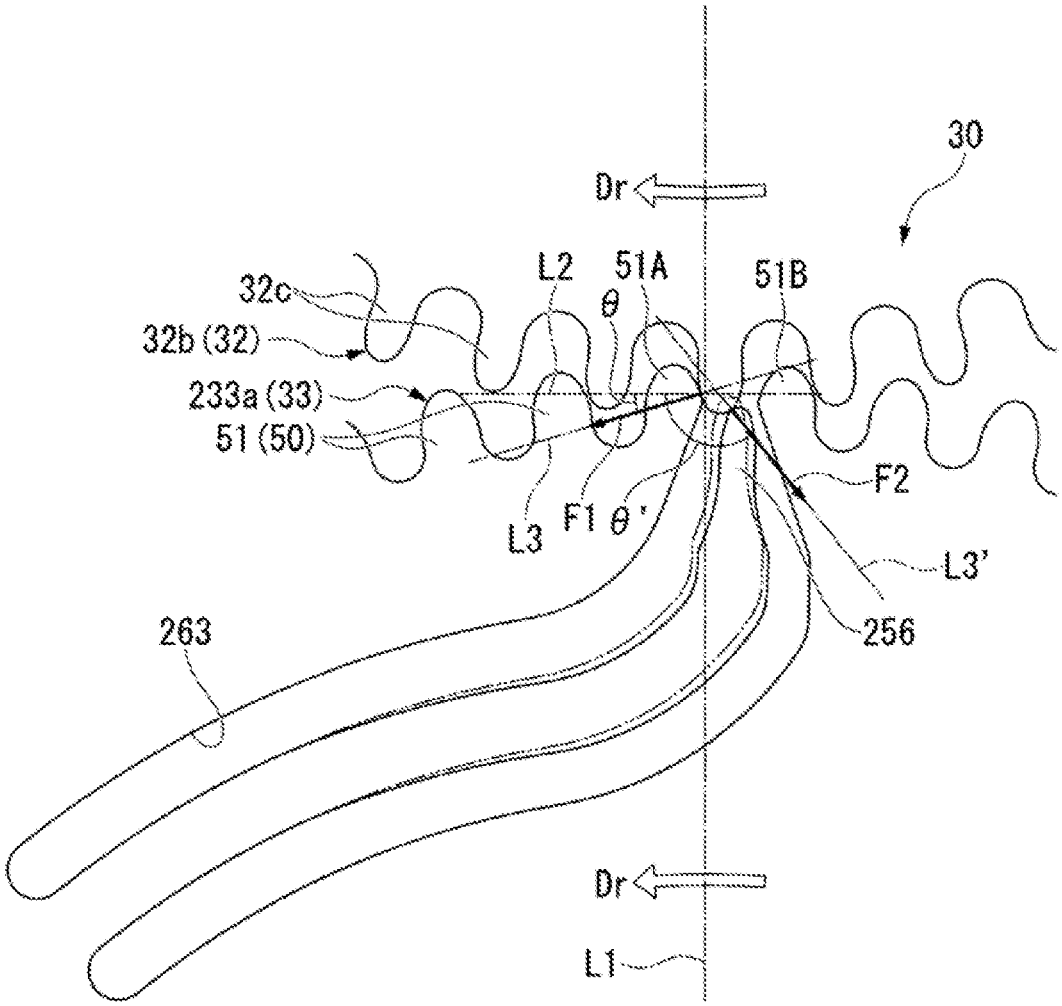
FIG. 21 is an enlarged view illustrating a meshing portion between the indicating hand gear and the second intermediate pinion in the train wheel according to the third embodiment.

FIGS. 20 and 21 are enlarged views illustrating a meshing portion between the indicating hand gear and the second intermediate pinion in the train wheel according to the third embodiment. FIG. 21 illustrates a state where the state in FIG. 20 is further rotated rearward.

As illustrated in FIG. 20, during the rearward rotation, before or after the timing at which the tooth engaging with the second intermediate pinion 32*b* is switched to the first standard tooth 51A, the tooth 32*c* of the second intermediate pinion 32*b* engaging with the first standard tooth 51A comes into contact with the tip of the elastic portion 256. Thereafter, as illustrated in FIG. 21, if the second intermediate pinion 32*b* engages with the first standard tooth 51A and the indicating hand gear 233*a* and the second intermediate pinion 32*b* are further rotated rearward, the tooth 32*c* of the second intermediate pinion 32*b* is elastically deformed so as to push the elastic portion 256 inward in the radial direction. In this way, when the first standard tooth 51A and the second intermediate pinion 32*b* engage with each other, the elastic portion 256 comes into contact with the second intermediate pinion 32*b*. In this manner, the train wheel 30 has the energy loss caused by the elastic deformation of the elastic portion 256. During the rearward rotation, the elastic portion 256 may come into contact with the tooth 32*c* of the second intermediate pinion 32*b* during at least a partial period in an engagement state between the first standard tooth 51A and the second intermediate pinion 32*b*.

Here, the tooth 32*c* of the second intermediate pinion 32*b* comes into contact with the tip of the elastic portion 256. Therefore, the pressure angle θ' in the contact portion between the elastic portion 256 and the second intermediate pinion 32*b* is larger than the pressure angle θ in the contact portion between the first standard tooth 51A and the second intermediate pinion 32*b*. In this manner, the force acting direction F2 from the second intermediate pinion 32*b* acting on the elastic portion 256 is inclined larger to the straight line L2, compared to the force acting direction F1 from the second intermediate pinion 32*b* acting on the first standard tooth 51A. Therefore, the torque transmission direction of the entire contact portion between the indicating hand gear 233*a* and the second intermediate pinion 32*b* is inclined larger to the straight line L2, compared to the torque transmission direction T (refer to FIG. 20) in a state where the standard tooth is not in contact with the elastic portion 256 during the rearward rotation. That is, during the rearward rotation, the elastic portion 256 is formed so that the torque transmission direction in the entire contact portion between the indicating hand gear 233*a* and the second intermediate pinion 32*b* in a state where the first standard tooth 51A and the second intermediate pinion 32*b* engage with each other is inclined larger to the straight line L2, compared to that in a state where the standard tooth 51 other than the first standard tooth 51A and the second intermediate pinion 32*b* engage with each. It is preferable to form the elastic portion 256 so that the torque transmission direction in the entire contact portion between the indicating hand gear 233*a* and the second intermediate pinion 32*b* during the rearward rotation is inclined smaller to the straight line L2, compared to that during the forward rotation.

In this way, the timepiece movement according to the present embodiment includes the train wheel 30 having the indicating hand gear 233*a* and the second intermediate pinion 32*b* which transmit the drive force of the motor 20 to the indicating hand 40 and which mesh with each other, and the elastic portion 256 which is disposed in the indicating hand gear 233*a* and which is elastically deformed by coming into contact with the second intermediate pinion 32*b* when the indicating hand 40 is located at the reference position. According to this configuration, similar to the first embodiment, it is possible to provide the timepiece movement in which the means for grasping the reference position of the indicating hand 40 can also be realized using the predetermined load for enabling the normal hand operation.

The elastic portion 256 is located between the first standard tooth 51A and the second standard tooth 51B. Both when the first standard tooth 51A and the second intermediate pinion 32*b* engage with each other, and when the second standard tooth 51B and the second intermediate pinion 32*b* engage with each other, the elastic portion 256 comes into contact with the second intermediate pinion 32*b*. According to this configuration, the rotation state of the rotor 202 can be changed by elastically deforming the elastic portion 256 during both the forward rotation and the rearward rotation. Accordingly, the control unit 10 can determine the reference position of the indicating hand 40 during the forward rotation and the rearward rotation.

The elastic portion 256 is the cantilever beam, at least a portion of which extends along the direction intersecting the radial direction, and whose free end is located between the first standard tooth 51A and the second standard tooth 51B. According to this configuration, the free end can be elastically displaced along the radial direction by bending the portion extending along the direction intersecting the radial direction in the elastic portion 256. Therefore, it is possible to form the elastic portion 256 which is elastically deformed by coming into contact with the second intermediate pinion 32*b*.

The elastic portion 256 is formed so that the torque transmission direction in the entire contact portion between the second intermediate pinion 32*b* and the indicating hand gear 233*a* in the state where the first standard tooth 51A and the second intermediate pinion 32*b* engage with each other is inclined larger to the straight line L2, compared to the state where the standard tooth 51 other than the first standard tooth 51A and the second intermediate pinion 32*b* engage with each other. According to this configuration, the transmission efficiency of the drive force of the motor 20 from the second intermediate pinion 32*b* to the indicating hand gear 233*a* in the state where the first standard tooth 51A and the second intermediate pinion 32*b* engage with each other becomes poorer than that in the state where the standard tooth 51 other than the first standard tooth 51A and the second intermediate pinion 32*b* engage with each other. Therefore, the rotation state of the rotor 202 can be changed by increasing the load received by the rotor 202 when the indicating hand 40 is located at the reference position.

According to the above-described third embodiment, the elastic portion 256 is formed so that the tip is displaced inward in the radial direction. However, the embodiment is not limited thereto. The elastic portion may be formed so as to extend from the base end toward the tip along the radial direction, and may be formed so that the tip is displaced in the circumferential direction of the indicating hand gear.

According to the above-described third embodiment, the elastic portion 256 comes into contact with the second intermediate pinion 32*b* both when the first standard tooth 51A and the second intermediate pinion 32*b* engage with each other and when the second standard tooth 51B and the second intermediate pinion 32*b* engage with each other. However, the embodiment is not limited thereto. The elastic portion may be formed so as to come into contact with the second intermediate pinion 32*b* either when the first standard tooth 51A and the second intermediate pinion 32*b* engage with each other or when the second standard tooth 51B and the second intermediate pinion 32*b* engage with each other.

Fourth Embodiment [Conform Style]

Figure 22:
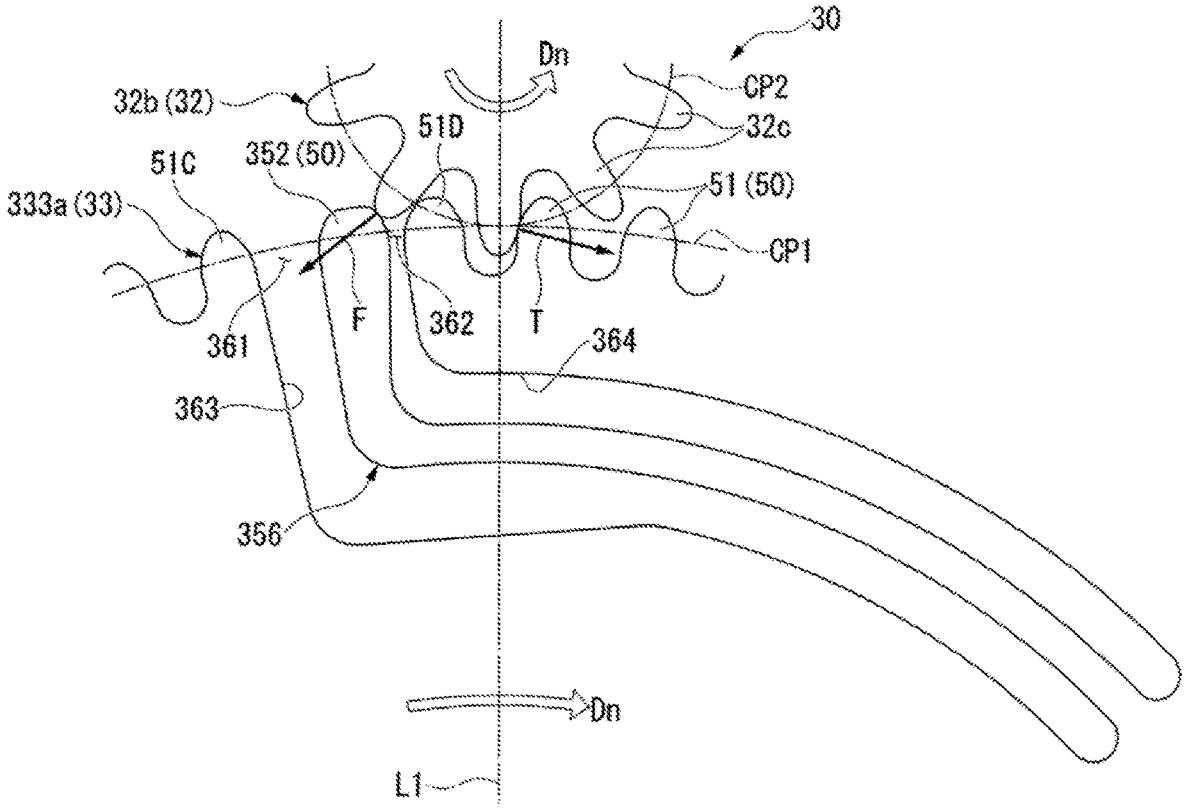
FIG. 22 is an enlarged view illustrating a meshing portion between an indicating hand gear and a second intermediate pinion in a train wheel according to a fourth embodiment.
Figure 23:
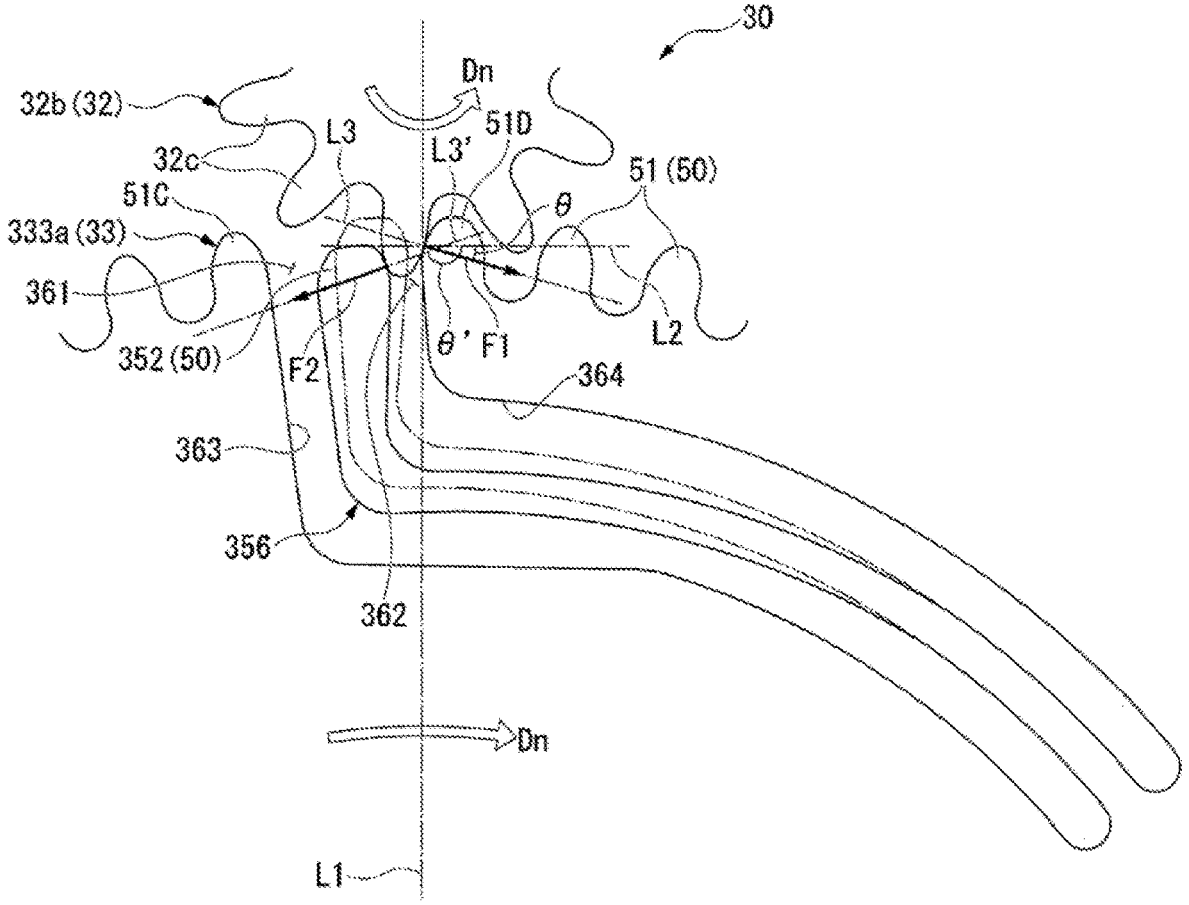
FIG. 23 is an enlarged view illustrating a meshing portion between the indicating hand gear and the second intermediate pinion in the train wheel according to the fourth embodiment.

FIGS. 22 and 23 are enlarged views illustrating a meshing portion of an indicating hand gear and a second intermediate pinion in a train wheel according to a fourth embodiment. FIG. 23 illustrates a state where the state in FIG. 22 is further rotated forward.

According to the first embodiment illustrated in FIG. 11, the elastic portion 56 is disposed so as to form a portion of the elastic tooth 52. In contrast, the fourth embodiment illustrated in FIG. 22 is different from the first embodiment in that an elastic portion 356 is disposed so as to form the entity of an elastic tooth 352 of an indicating hand gear 333*a*.

As illustrated in FIG. 22, the indicating hand gear 333*a* has the plurality of teeth 50 and the elastic portion 356. The plurality of teeth 50 of the indicating hand gear 333*a* are the standard tooth 51 and the elastic tooth 352. The elastic tooth 352 is one tooth of the plurality of teeth 50 belonging to the indicating hand gear 333*a*. The elastic tooth 352 increases the load received by the rotor 202 when the indicating hand 40 is located at the reference position which is the above-described reference load unit. The entire elastic tooth 352 is formed from the elastic portion 356. The plurality of standard teeth 51 include a first standard tooth 51C and a second standard tooth 51D which are adjacent to the elastic tooth 352. The first standard tooth 51C is located on the upstream side in the forward rotation direction which is one ahead of the elastic tooth 352. The second standard tooth 51D is located on the downstream side in the forward rotation direction which is one ahead of the elastic tooth 352.

The tooth thickness of the elastic tooth 352 is thicker than the tooth thickness of the standard tooth 51. The width of a tooth groove 362 between the elastic tooth 352 and the second standard tooth 51D is smaller than the tooth thickness of the tooth 32*c* of the second intermediate pinion 32*b*. The width of the tooth groove 362 is the distance between the elastic tooth 352 and the second standard tooth 51D on the pitch circle CP1 of the indicating hand gear 333*a*. In this manner, if the tooth 32*c* of the second intermediate pinion 32*b* enters the tooth groove 362 between the elastic tooth 352 and the second standard tooth 51D, the tooth 32*c* of the second intermediate pinion 32*b* comes into contact with the elastic tooth 352.

A first slit 363 is linked to the tooth groove 361 between the elastic tooth 352 and the first standard tooth 51C. The first slit 363 extends inward in the radial direction and along the radial direction from the tooth groove 361 between the elastic tooth 352 and the first standard tooth 51C, and thereafter, extends while being bent toward the downstream side in the forward rotation direction. A second slit 364 is linked to the tooth groove 362 between the elastic tooth 352 and the second standard tooth 51D. The second slit 364 extends along the first slit 363.

The elastic portion 356 is a portion between the first slit 363 and the second slit 364. The tip of the elastic portion 356 has the elastic tooth 352. The elastic portion 356 is the cantilever beam extending while the portion between the innermost end of the first slit 363 and the innermost end of the second slit 364 is used as the base end. The elastic portion 356 extends from the base end toward the upstream side in the forward rotation direction, and thereafter, extends outward in the radial direction and along the radial direction. That is, the portion of the elastic portion 356 extends along the direction intersecting the radial direction. As illustrated in FIG. 23, the elastic portion 356 is elastically deformed so that the tip (free end) is displaced inward in the radial direction while the base end is used as a fulcrum.

Subsequently, a relationship between the indicating hand gear 333*a* and the second intermediate pinion 32*b* will be described using an operation example when the train wheel 30 is rotated forward.

As illustrated in FIG. 22, during the forward rotation, before and after the timing at which the tooth engaging with the second intermediate pinion 32*b* is switched to the second standard tooth 51D, the tooth 32*c* of the second intermediate pinion 32*b* engaging with the second standard tooth 51D comes into contact with the elastic tooth 352. In this case, the force in the direction indicated by the reference numeral F acts on the elastic tooth 352 from the tooth 32*c* of the second intermediate pinion 32*b*.

Thereafter, as illustrated in FIG. 23, if the second intermediate pinion 32*b* engages with the second standard tooth 51D and the indicating hand gear 333*a* and the second intermediate pinion 32*b* are further rotated forward, the tooth 32*c* of the second intermediate pinion 32*b* elastically deforms the elastic tooth 352 inward in the radial direction and toward the upstream side in the forward rotation direction. The tooth 32*c* of the second intermediate pinion 32*b* is interposed between the second standard tooth 51D and the elastic tooth 352. In this way, when the second standard tooth 51D and the second intermediate pinion 32*b* engage with each other, the elastic portion 356 comes into contact with the second intermediate pinion 32*b*. In this manner, the train wheel 30 has the energy loss caused by the elastic deformation of the elastic portion 356.

The pressure angle θ' in the contact portion between the elastic portion 356 and the second intermediate pinion 32*b* is larger than the pressure angle θ in the contact portion between the second standard tooth 51D and the second intermediate pinion 32*b*. The pressure angle θ' is an angle formed by the straight line L2 and the common normal line L3' of each contact surface of the elastic portion 356 and the second intermediate pinion 32*b* in the contact portion between the elastic portion 356 and the second intermediate pinion 32*b*. In this manner, the force acting direction F2 from the second intermediate pinion 32*b* acting on the elastic portion 356 is inclined larger to the straight line L2, compared to the force acting direction F1 from the second intermediate pinion 32*b* acting on the second standard tooth 51D. Therefore, the torque transmission direction of the entire contact portion between the indicating hand gear 333*a* and the second intermediate pinion 32*b* is inclined larger to the straight line L2, compared to the torque transmission direction T (refer to FIG. 22) in a state where the second intermediate pinion 32*b* is not in contact with the elastic portion 356 during the forward rotation. That is, during the forward rotation, the elastic portion 356 is formed so that the torque transmission direction in the entire contact portion between the indicating hand gear 333*a* and the second intermediate pinion 32*b* in a state where the second standard tooth 51D and the second intermediate pinion 32*b* engage with each other is inclined larger to the straight line L2, compared to that in a state where the standard tooth 51 other than the second standard tooth 51D and the second intermediate pinion 32*b* engage with each. The torque transmission direction in the entire contact portion between the indicating hand gear 333*a* and the second intermediate pinion 32*b* coincides with the direction of the sum of the vector of the force acting in the direction indicated by the reference numeral F1 and the vector of the force acting in the direction indicated by the reference numeral F2.

Although not illustrated, when the tooth engaging with the second intermediate pinion 32*b* is switched to the elastic tooth 352, the elastic tooth 352 is elastically deformed regardless of the rotation direction of the indicating hand gear 333*a*. Specifically, during the forward rotation, if the tooth engaging with the second intermediate pinion 32*b* is switched from the second standard tooth 51D to the elastic tooth 352, the elastic tooth 352 is elastically deformed toward the downstream side in the forward rotation direction. During the rearward rotation, if the tooth engaging with the second intermediate pinion 32*b* is switched from the first standard tooth 51C to the elastic tooth 352, the elastic tooth 352 is elastically deformed toward the downstream side in the rearward rotation direction.

In this way, the timepiece movement according to the present embodiment includes the train wheel 30 having the indicating hand gear 333*a* and the second intermediate pinion 32*b* which transmit the drive force of the motor 20 to the indicating hand 40 and which mesh with each other, and the elastic portion 356 which is disposed in the indicating hand gear 333*a* and which is elastically deformed by coming into contact with the second intermediate pinion 32*b* when the indicating hand 40 is located at the reference position. According to this configuration, similar to the first embodiment, it is possible to provide the timepiece movement in which the means for grasping the reference position of the indicating hand 40 can also be realized using the predetermined load for enabling the normal hand operation.

The indicating hand gear 333*a* includes the elastic tooth 352 in which one entire tooth of the plurality of teeth is formed from the elastic portion 356, which is the tooth 50 belonging to the indicating hand gear 333*a*. According to this configuration, when the second intermediate pinion 32*b* engages with the elastic tooth 352, the second intermediate pinion 32*b* comes into contact with the elastic portion 356 regardless of the rotation direction of the indicating hand gear 333*a*. In this manner, the elastic portion 356 is elastically deformed regardless of the rotation direction of the indicating hand gear 333*a*. Therefore, the rotation state of the rotor 202 can be changed by elastically deforming the elastic portion 356 regardless of the rotation direction of the indicating hand gear 333*a*. Accordingly, when the indicating hand gear 333*a* is rotated, the control unit 10 can determine the reference position of the indicating hand 40.

The width of the tooth groove 362 between the elastic tooth 352 and the second standard tooth 51D adjacent to the elastic tooth 352 is smaller than the tooth thickness of the tooth 32*c* belonging to the second intermediate pinion 32*b*. According to this configuration, when the tooth 32*c* of the second intermediate pinion 32*b* enters the tooth groove 362 between the elastic tooth 352 and the second standard tooth 51D, the tooth 32*c* of the second intermediate pinion 32*b* can be brought into contact with the elastic tooth 352. In this manner, not only in a state where the elastic tooth 352 engages with the second intermediate pinion 32*b*, but also in a state where the second standard tooth 51D adjacent to the elastic tooth 352 engages with the second intermediate pinion 32*b*, the elastic portion 356 is elastically deformed by coming into contact with the second intermediate pinion 32*b*. In this manner, the rotation state of the rotor 202 can be changed for a longer period of time. Therefore, the control unit 10 can achieve improved accuracy in detecting the reference position of the indicating hand 40.

Fifth Embodiment

Figure 24:
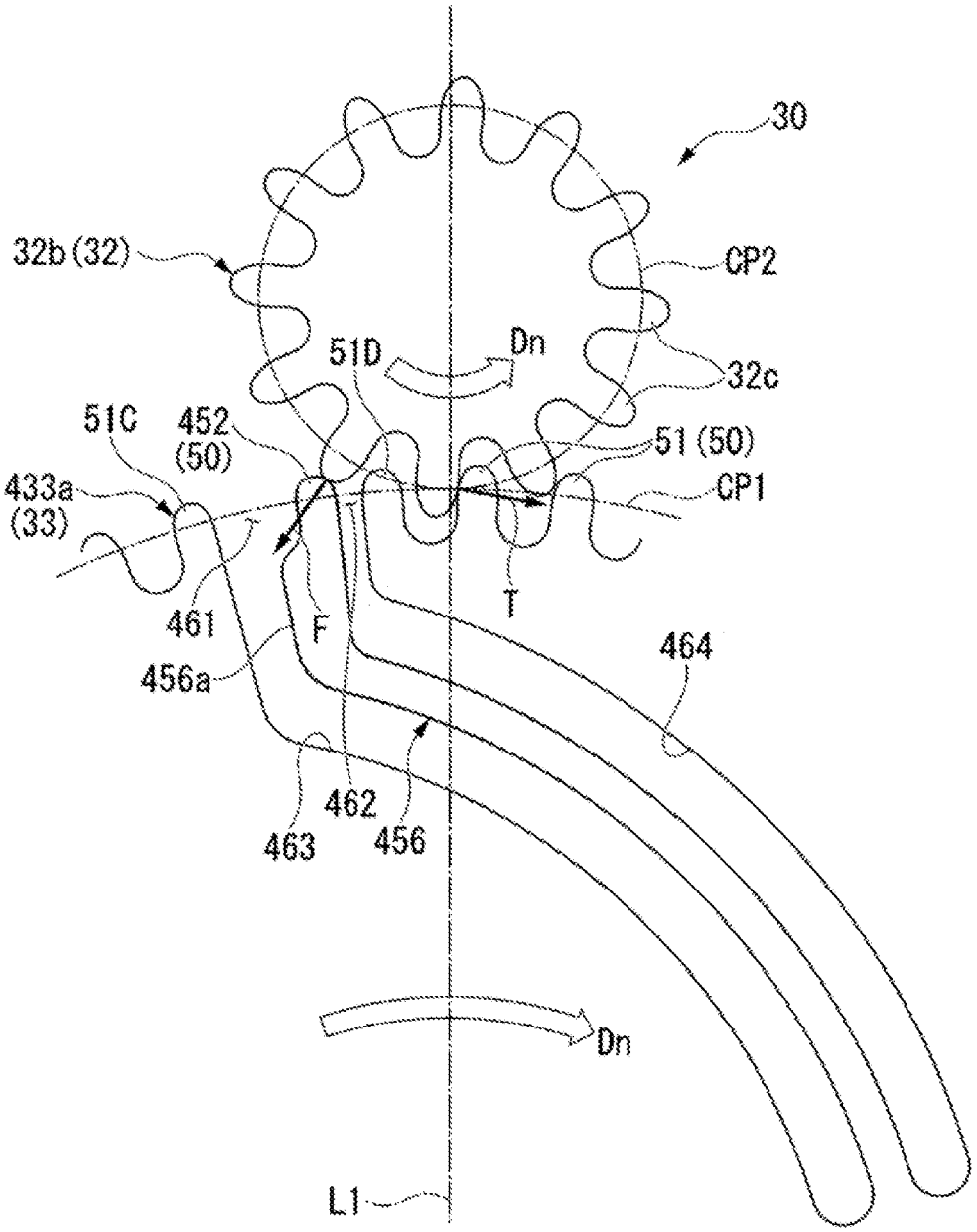
FIG. 24 is an enlarged view illustrating a meshing portion between an indicating hand gear and a second intermediate pinion in a train wheel according to a fifth embodiment.
Figure 25:
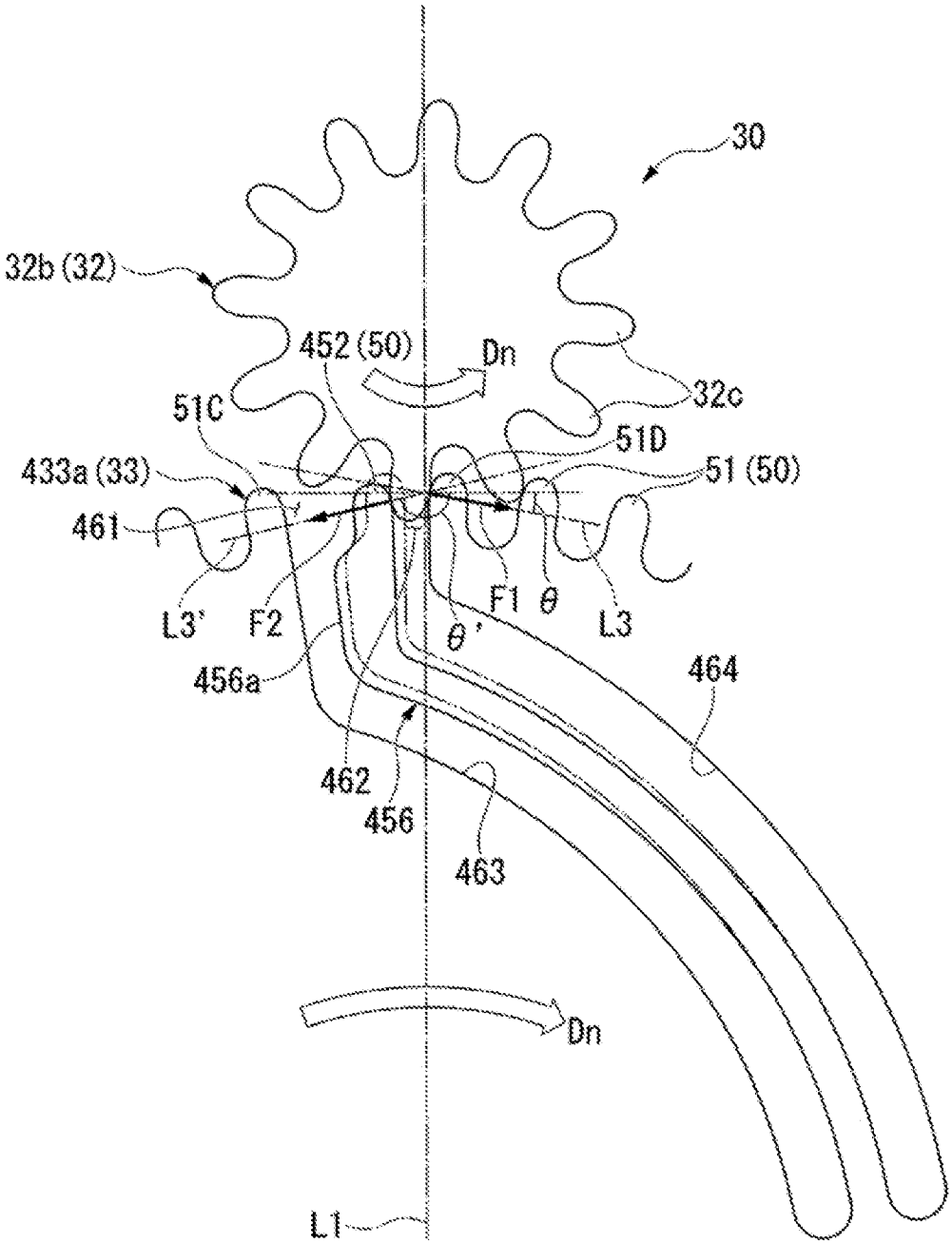
FIG. 25 is an enlarged view illustrating a meshing portion between the indicating hand gear and the second intermediate pinion in the train wheel according to the fifth embodiment.

FIGS. 24 and 25 are enlarged views illustrating a meshing portion of an indicating hand gear and a second intermediate pinion in a train wheel according to a fifth embodiment. FIG. 25 illustrates a state where the state in FIG. 24 is further rotated forward.

According to the fourth embodiment illustrated in FIG. 22, the tooth thickness of the elastic tooth 352 is thicker than the tooth thickness of the standard tooth 51. In contrast, the fifth embodiment illustrated in FIG. 24 is different from the fourth embodiment in that the tooth thickness of the elastic tooth 452 is the same as the tooth thickness of the standard tooth 51.

As illustrated in FIG. 24, an indicating hand gear 433*a* includes an elastic tooth 452 instead of the elastic tooth 352 of the indicating hand gear 333*a* according to the fourth embodiment. The indicating hand gear 433*a* includes an elastic portion 456 instead of the elastic portion 356 of the indicating hand gear 333*a* according to the fourth embodiment.

The elastic tooth 452 is the above-described reference load unit. The entire elastic tooth 452 is formed from the elastic portion 456. The tooth tip of the elastic tooth 452 is formed in a shape the same as that of a portion on the tooth tip side (outer side in the radial direction) from the pitch circle CP1 of the indicating hand gear 433*a* in the standard tooth 51. The elastic tooth 452 is located on the downstream side in the forward rotation direction from an intermediate position of the pair of standard teeth 51 adjacent to the elastic tooth 452. The width of a tooth groove 461 between the elastic tooth 452 and the first standard tooth 51C is thicker than the tooth thickness of the tooth 32*c* of the second intermediate pinion 32*b*. In this manner, the tooth 32*c* of the second intermediate pinion 32*b* can enter the tooth groove 461 between the elastic tooth 452 and the first standard tooth 51C without coming into contact with the elastic tooth 452. The width of the tooth groove 462 between the elastic tooth 452 and the second standard tooth 51D is smaller than the tooth thickness of the tooth 32*c* of the second intermediate pinion 32*b*. In this manner, if the tooth 32*c* of the second intermediate pinion 32*b* enters the tooth groove 462 between the elastic tooth 452 and the second standard tooth 51D, the tooth 32*c* of the second intermediate pinion 32*b* comes into contact with the elastic tooth 452 (refer to FIG. 25).

The first slit 463 is linked to the tooth groove 461 between the elastic tooth 452 and the first standard tooth 51C. The first slit 463 extends inward in the radial direction from the tooth groove 461 between the elastic tooth 452 and the first standard tooth 51C along the radial direction toward the inside of the radial direction, and thereafter, extends while being bent toward the downstream side in the forward rotation direction. The second slit 464 is linked to the tooth groove 462 between the elastic tooth 452 and the second standard tooth 51D. The second slit 464 extends along the first slit 463.

The elastic portion 456 is a portion between the first slit 463 and the second slit 464. The tip of the elastic portion 456 has the elastic tooth 452. The elastic portion 456 is the cantilever beam extending while the portion between the innermost end of the first slit 463 and the innermost end of the second slit 464 is used as the base end. The elastic portion 456 extends from the base end toward the upstream side in the forward rotation direction, and thereafter, extends outward in the radial direction and along the radial direction. That is, a portion of the elastic portion 456 extends along a direction intersecting the radial direction. The elastic portion 456 is elastically deformed so that the tip (free end) is displaced inward in the radial direction while the base end is used as a fulcrum (refer to FIG. 25).

The elastic portion 456 has a wide portion 456*a*. The wide portion 456*a* is formed to be wider than the elastic tooth 452 in a plan view. The wide portion 456*a* is adjacent to the base end side of the elastic portion 456 with respect to the elastic tooth 452. The wide portion 456*a* is disposed in a portion extending along the radial direction in the elastic portion 456.

Subsequently, a relationship between the indicating hand gear 433*a* and the second intermediate pinion 32*b* will be described using an operation example when the train wheel 30 is rotated rearward. The operation of the train wheel 30 during the forward rotation illustrated in FIGS. 24 and 25 is the same as that according to the fourth embodiment illustrated in FIGS. 22 and 23. Therefore, description thereof will be omitted.

Figure 26:
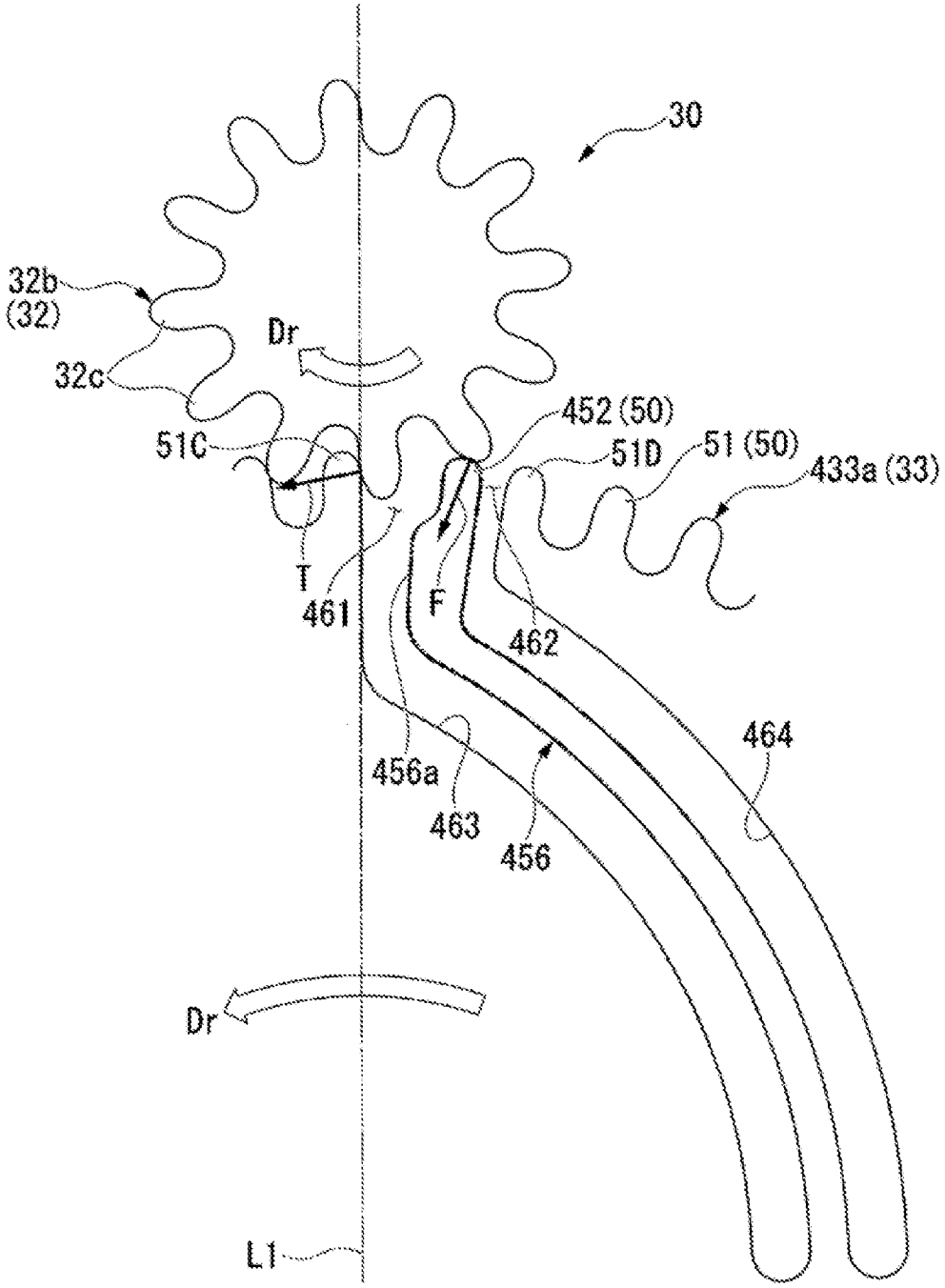
FIG. 26 is an enlarged view illustrating a meshing portion between the indicating hand gear and the second intermediate pinion in the train wheel according to the fifth embodiment.
Figure 27:
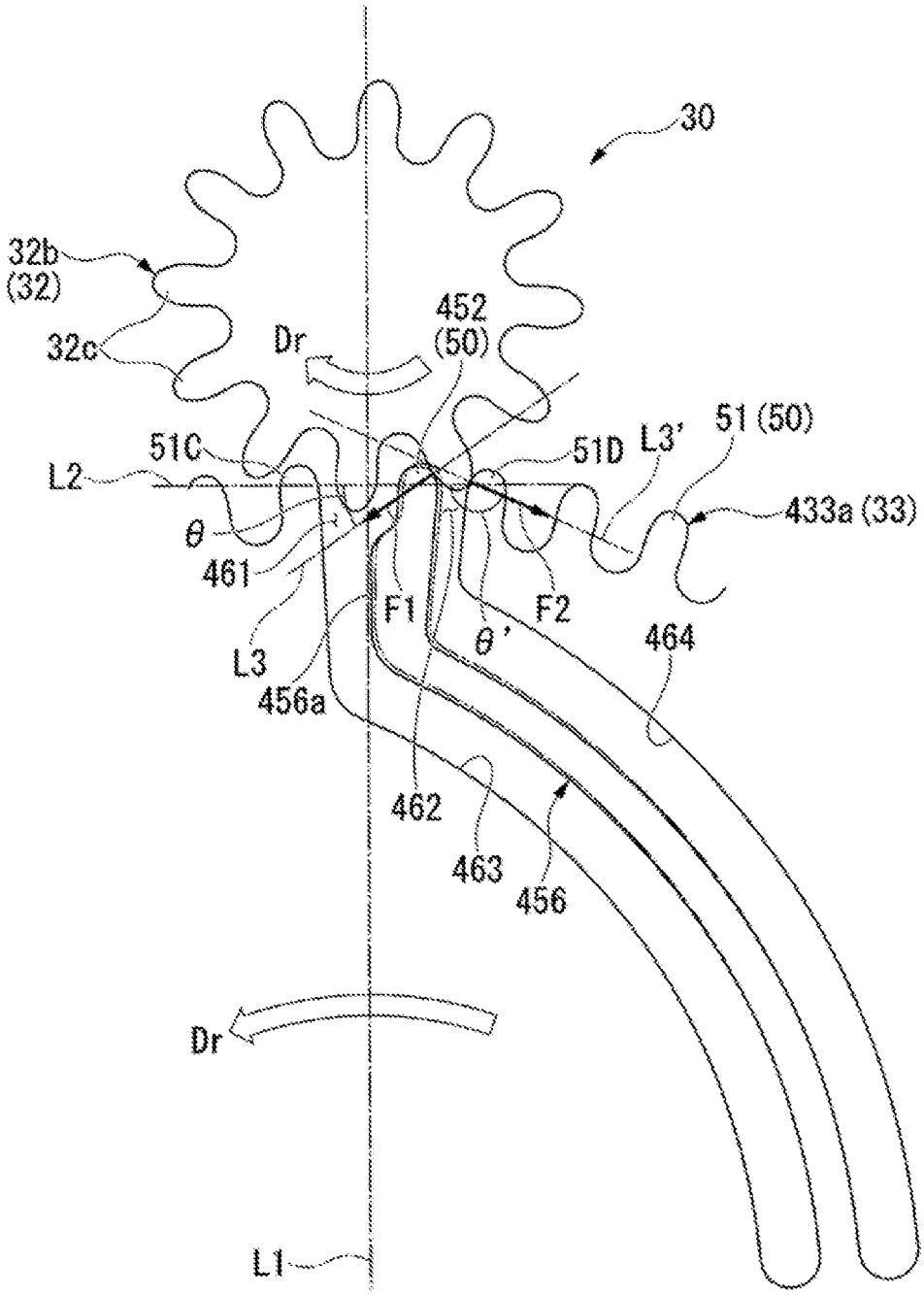
FIG. 27 is an enlarged view illustrating a meshing portion between the indicating hand gear and the second intermediate pinion in the train wheel according to the fifth embodiment.

FIGS. 26 and 27 are enlarged views illustrating a meshing portion of an indicating hand gear and a second intermediate pinion in a train wheel according to a fifth embodiment. FIG. 27 illustrates a state where the state in FIG. 26 is further rotated rearward.

As illustrated in FIG. 26, during the rearward rotation, in a state where the first standard tooth 51C engages with the second intermediate pinion 32*b*, the tooth 32*c* on the upstream side in the rearward rotation direction which is one ahead of the tooth 32*c* engaging with the first standard tooth 51C of the plurality of teeth 32*c* of the second intermediate pinion 32*b* comes into contact with the elastic tooth 452. The tooth 32*c* of the second intermediate pinion 32*b* comes into contact with the elastic tooth 452 from the outer side in the radial direction the upstream side in the rearward rotation direction. In this case, the force in the direction indicated by the reference numeral F acts on the elastic tooth 452 from the tooth 32*c* of the second intermediate pinion 32*b*.

Thereafter, as illustrated in FIG. 27, the tooth 32*c* of the second intermediate pinion 32*b* which comes into contact with the elastic tooth 452 moves the elastic tooth 452 forward while elastically deforming the elastic portion 456. In this manner, the indicating hand gear 433*a* is progressively rotated rearward, and the first standard tooth 51C and the second intermediate pinion 32*b* disengage from each other. The tooth 50 engaging with the second intermediate pinion 32*b* is switched from the first standard tooth 51C to the elastic tooth 452. While the tooth 32*c* of the second intermediate pinion 32*b* elastically deforms the elastic tooth 452 inward in the radial direction and toward the downstream side in the rearward rotation direction, the tooth 32*c* of the second intermediate pinion 32*b* enters the tooth groove 462 between the elastic tooth 452 and the second standard tooth 51D. The tooth 32*c* of the second intermediate pinion 32*b* is interposed between the second standard tooth 51D and the elastic tooth 452. In this way, the elastic portion 456 comes into contact with the second intermediate pinion 32*b* when the elastic tooth 452 and the second intermediate pinion 32*b* engage with each other. In this manner, the train wheel 30 has the energy loss caused by the elastic deformation of the elastic portion 456.

The pressure angle θ' in the contact portion between the second standard tooth 51D and the second intermediate pinion 32*b* is larger than the pressure angle θ in the contact portion between the elastic portion 456 and the second intermediate pinion 32*b*. In this manner, the force acting direction F2 from the second intermediate pinion 32*b* acting on the second standard tooth 51D is inclined larger to the straight line L2, compared to the force acting direction F1 from the second intermediate pinion 32*b* acting on the elastic portion 456. Therefore, the torque transmission direction in the entire contact portion between the indicating hand gear 433*a* and the second intermediate pinion 32*b* is inclined larger to the straight line L2, compared to the torque transmission direction T (refer to FIG. 26) in a state where the standard tooth does not come into contact with the elastic portion 456 during the rearward rotation. That is, during the rearward rotation, the elastic portion 456 is formed so that the torque transmission direction in the entire contact portion between the indicating hand gear 433*a* and the second intermediate pinion 32*b* in a state where the elastic tooth 452 and the second intermediate pinion 32*b* engage with each other is inclined larger to the straight line L2, compared to that in a state where the standard tooth 51 and the second intermediate pinion 32*b* engage with each other. The torque transmission direction in the entire contact portion between the indicating hand gear 433*a* and the second intermediate pinion 32*b* coincides with the direction of the sum of the vector of the force acting in the direction indicated by the reference numeral F1 and the vector of the force acting in the direction indicated by the reference numeral F2.

The timepiece movement according to the present embodiment configured in this way achieves the following operation effects in addition to the operation effects achieved by the timepiece movement according to the above-described fourth embodiment.

In the timepiece movement according to the present embodiment, the tooth tip of the elastic tooth 452 is formed in a shape the same as that of a portion on the tooth tip side (outer side in the radial direction) from the pitch circle CP1 of the indicating hand gear 433*a* in the standard tooth 51. According to this configuration, the elastic tooth 452 can be prevented from being fitted to the tooth bottom of the second intermediate pinion 32*b*. The shape of the tooth tip of the elastic tooth 452 is formed to be the same as the shape of the tooth tip of the standard tooth 51. Accordingly, even if the shape of the tooth tip of the elastic tooth 452 varies during the manufacturing, it is possible to prevent the second intermediate pinion 32*b* and the elastic tooth 452 from poorly engaging with each other. In this manner, it is possible to prevent the energy loss caused by the elastic deformation of the elastic portion 456 from significantly increasing beyond a desired magnitude. According to the above-described configurations, fluctuations in the load received by the rotor 202 can be stabilized.

The elastic portion 456 is the cantilever beam whose free end has the elastic tooth 452, and has the wide portion 456*a* formed adjacent to the base end side with respect to the elastic tooth 452 and to be wider than the elastic tooth 452. According to this configuration, compared to a case where the elastic portion does not have the wide portion, it is possible to improve rigidity of a portion adjacent to the base end side with respect to the elastic tooth 452 in the elastic portion 456. Accordingly, the portion adjacent to the elastic tooth 452 in the elastic portion 456 is prevented from being locally bent. In this manner, the elastic tooth 452 can be displaced with a desired trajectory by bending the entire elastic portion 456. Therefore, the fluctuation of the load received by the rotor 202 can be stabilized.

The present invention is not limited to the above embodiments described with reference to the drawings. Various modification examples are conceivable in the technical scope of the present invention.

For example, in the above-described embodiments, each of the indicating hands 40*a* to 40*c* is provided with the motors 20*a* to 20*c*. However, the embodiments are not limited thereto. Each of the indicating hands 40*a* to 40*c* may be configured to be driven by one of the motors 20. In this case, it is preferable that the elastic portion is disposed in the gear located at a position closer to the motor 20 on the transmission route of the drive force of the motor 20, in the gears belonging to the train wheel. In this manner, it is possible to prevent the fluctuations in load applied to the rotor from being buried in noise.

Alternatively, within the scope not departing from the gist of the present invention, it is possible to appropriately substitute the configuration elements in the above-described embodiments with well-known configuration elements. In addition, the above-described respective embodiments and modification examples may be appropriately combined with each other.

What is claimed is:

1. A timepiece movement comprising:

a stepping motor that has a rotor for rotating an indicating hand;

a control circuit configured to apply a main drive pulse and an auxiliary drive pulse to rotate the rotor, detect a rotation state of the rotor when the indicating hand is rotated by application of a detection drive pulse based on the main drive pulse, and determine a reference position of the indicating hand based on the detected rotation state of the rotor;

a train wheel configured to transmit a drive force of the stepping motor to the indicating hand, the train wheel having a first gear and a second gear which mesh with each other; and an elastic portion formed in the first gear, wherein the elastic portion is elastically deformed upon contact with the second gear when the indicating hand is located at the reference position, wherein the first gear includes an elastic tooth having a first tooth surface facing an upstream direction of rotation of the first gear and a second tooth surface facing a downstream direction of the rotation of the first gear, wherein the elastic portion comprises at least one of the first tooth surface and the second tooth surface.

2. The timepiece movement according to claim 1, wherein one of the first tooth surface and the second tooth surface is formed of an elastic material and the other of them is formed of a rigid material.

3. The timepiece movement according to claim 1, wherein the elastic tooth is one of a plurality of teeth formed around the first gear.

4. The timepiece movement according to claim 1, wherein the first gear includes a pair of elastic teeth arranged adjacent to each other, wherein a width of a tooth groove between the pair of elastic teeth is smaller than a tooth thickness of the teeth formed around the second gear, wherein the pair of elastic teeth have tooth surfaces facing each other in a circumferential direction, and wherein the tooth surfaces are formed from the elastic portion.

5. The timepiece movement according to claim 1, wherein the first gear has a first tooth and a second tooth adjacent to each other, and wherein the elastic portion is located between the first tooth and the second tooth, and comes into contact with the second gear either when the first tooth and second gear engage with each other or when the second tooth and the second gear engage with each other.

6. The timepiece movement according to claim 5, wherein at least a portion of the elastic portion is formed as a cantilever beam which extends in a direction intersecting a radial direction of the first gear, and whose free end is located between the first tooth and the second tooth.

7. The timepiece movement according to claim 1, wherein the first gear includes an elastic tooth formed of the elastic portion.

8. The timepiece movement according to claim 7, wherein a width of a tooth groove between the elastic tooth and a tooth adjacent to the elastic tooth is smaller than a tooth thickness of teeth formed around the second gear.

9. The timepiece movement according to claim 2, wherein the plurality of teeth formed around the first gear include the elastic tooth and standard teeth, and wherein a tooth tip of the elastic tooth is formed in a shape identical to that of a portion on a tooth tip side from a pitch circle of the first gear in the standard tooth.

10. The timepiece movement according to claim 7, wherein the elastic portion is formed as a cantilever beam whose free end has the elastic tooth, and has a wide portion which is formed to be wider than the elastic tooth while being adjacent to a base end side of the elastic tooth.

11. The timepiece movement according to claim 1, wherein the elastic portion is formed so that a torque transmission direction in a contact portion between the first gear and the second gear is more greatly inclined to a straight line perpendicular to a center line between the first gear and the second gear in a contact state between the elastic portion and the second gear, compared to an engagement state between a site other than the elastic portion in the first gear and the second gear.

12. The timepiece movement according to claim 1, wherein the indicating hand is attached to the first gear.

13. A timepiece comprising the timepiece movement according to claim 1.

* * * * *